United States Patent [19]

Ogura

[11] Patent Number: 4,792,827

[45] Date of Patent: Dec. 20, 1988

[54] DISPLAY DEVICE

[75] Inventor: Masahiko Ogura, Yokohama, Japan

[73] Assignee: Kabushiki Kaisha Toshiba, Kawasaki, Japan

[21] Appl. No.: 879,191

[22] Filed: Jun. 26, 1986

[30] Foreign Application Priority Data

Jun. 28, 1985 [JP] Japan ..... 60-142117

[51] Int. Cl.[4] ..... G03G 15/00

[52] U.S. Cl. ..... 355/14 C; 355/3 R; 355/14 R; 340/28 GM; 340/525

[58] Field of Search ..... 355/14 R, 14 C, 3 R; 340/286 M, 525, 715, 784

[56] References Cited

U.S. PATENT DOCUMENTS

| | | | |
|---|---|---|---|
| 4,500,971 | 2/1985 | Futaki et al. | 364/513.5 |
| 4,559,519 | 12/1985 | Matsumoto et al. | 355/14 C X |
| 4,627,713 | 12/1986 | Abuyamo | 355/14 R |
| 4,641,953 | 2/1987 | Oushiden et al. | 355/14 R |
| 4,668,978 | 5/1979 | Gokita | 355/14 C X |
| 4,677,310 | 6/1987 | Midorikand et al. | 355/14 R X |

*Primary Examiner*—A. C. Prescott

*Attorney, Agent, or Firm*—Cushman, Darby & Cushman

[57] ABSTRACT

A display device for use in an image forming apparatus which includes, a detection member for detecting the condition of the image forming apparatus, a display section for normally displaying a condition message which represents the conditions of the image forming apparatus on the basis of the detection by the detection member, and a first input key for causing a first message to be displayed on the display section. The first message represents guidance for operating of the image forming apparatus. A second input key is also provided for causing a second message to be displayed on the display section, the second message representing guidance for following the operation procedure of the image forming apparatus. A third input key is further provided for causing a third message to be displayed on the displaying seciton, the third message representing guidance, different from the first message, for an operation procedure of the image forming apparatus.

7 Claims, 35 Drawing Sheets

DISPLAY DEVICE

BACKGROUND OF THE INVENTION

1. Field of the Invention

The present invention relates to a display device in an image forming apparatus such as a copying machine, which displays a condition message and guidance for operation of the image forming apparatus.

2. Description of the Prior Art

Much progress has been made recently in copying machines, for example, with the variety of functions the copying machines are capable of performing. However, the methods of operating the apparatus and procedures of follow if problems occur have become complex, which means that until he or she becomes used to the apparatus the user must refer to an instruction manual each time he or she carries out operations and there are problems such as wasted copying because of mistakes in operational procedures.

SUMMARY OF THE INVENTION

It is an object of the present invention to provide a display device for use in an image forming apparatus, which permits the user to carry out required operations simply but surely without consulting an instruction manual, etc. each time and which also eliminates waste due to incorrect operations.

According to one aspect of the present invention, a display device is provided for use in an image forming apparatus, comprising:

detecting means for detecting the condition of the image forming apparatus;

display means for normally displaying a condition message which represents the condition of the image forming apparatus on the basis of the detection by the detection means;

first input means for causing a first message to be displayed on the display means, the first message representing guidance for operation of the image forming apparatus;

second input means for causing a second message to be displayed on the display means, the second message representing guidance for a following operation of the image forming apparatus; and third input means for causing a third message to be displayed on the displaying means, the third message representing guidance, different from the first message, for operation of the image forming apparatus.

BRIEF DESCRIPTION OF THE DRAWINGS

FIGS. 1 through 47 show an embodiment of a display device according to the present invention, in which:

FIG. 1 is a plan view of a control panel;

FIG. 2 is a block diagram showing a control circuit;

FIG. 3 through FIG. 6 are flowcharts for explaining the operations;

FIG. 8 is an external perspective view of a copying machine;

FIG. 9 is a schematic front view, in longitudinal section, of a copying machine;

FIG. 10 is a schematic front view, in longitudinal section, of the copying machine main body;

FIG. 11 is an operational schematic elevation of the structure of an optical exposure apparatus;

FIG. 12 is an operational schematic elevation showing a cooling air guideway;

FIG. 13 is a perspective view of a means for operating first and second optical units of the optical exposure apparatus;

FIG. 14 is an operational section of a main part of the means of FIG. 13;

FIG. 15 is a plane view showing a means for operating a lens unit and a third optical unit of the optical exposure apparatus;

FIG. 16 is a schematic front view, in longitudinal section, of a two-color development unit;

FIGS. 17 and 18 are sectional views illustrating different operating states of a 1st development unit;

FIGS. 19 and 20 are sectional views showing different operating states of a second development unit;

FIGS. 21 and 22 are sectional views showing development apparatus operating states;

FIG. 23 is a front view showing the copying machine with the front cover opened;

FIG. 24 is a schematic front view, in longitudinal section, of a supplementary developer supply unit;

FIG. 25 is a schematic side view, in longitudinal section, of the supplementary developer supply unit;

FIG. 27 is a schematic plane view showing construction in the vicinity of the 2nd development unit's developer reception and transport section;

FIG. 28 is a schematic cross-section of the supplementary developer supply unit;

FIG. 29 is schematic disassembly perspective view of the supplementary developer supply unit;

FIG. 30 is a schematic front view of a paper supply unit section;

FIG. 31 is a perspective view showing the state when a paper supply cassette's cover is removed;

FIG. 32 is a perspective view of a cassette cover that also serves as a manually inserted paper supply block;

FIG. 33 is a plan view showing how guide members of the manually inserted paper supply block are mounted and supported;

FIG. 34 is a section along the line I—I of FIG. 33;

FIG. 35 is a section along the line II—II of FIG. 33;

FIG. 36 is a schematic perspective view of a support plate lifting mechanism for raising a paper supply cassette support plate;

FIG. 37 is a schematic perspective view of the construction of a separation means;

FIG. 40 is a schematic plan view showing the construction of a take-out roller and registration roller drive system;

FIG. 41 is a schematic plane view of a contact-disengagement means for effecting contact and disengagement of manual insertion rollers;

FIG. 43 is a schematic front view, in longitudinal section, of a direction-change transport unit;

FIG. 44 is a front view showing the construction of a copy paper directing section of the direction-change transport unit;

FIG. 45 is a front view, partially cut away, showing the construction of a section where copy paper is carried into a temporary stacking section in the direction-change transport unit;

FIG. 46 is a perspective view of main parts of this copy paper carry-in section; and FIG. 47 is a side view, partially cut away, of the copy paper carry-in section.

DETAILED DESCRIPTION OF THE PREFERRED EMBODIMENTS

An embodiment of the invention will now be described with reference to the attached drawings.

Figure 8:
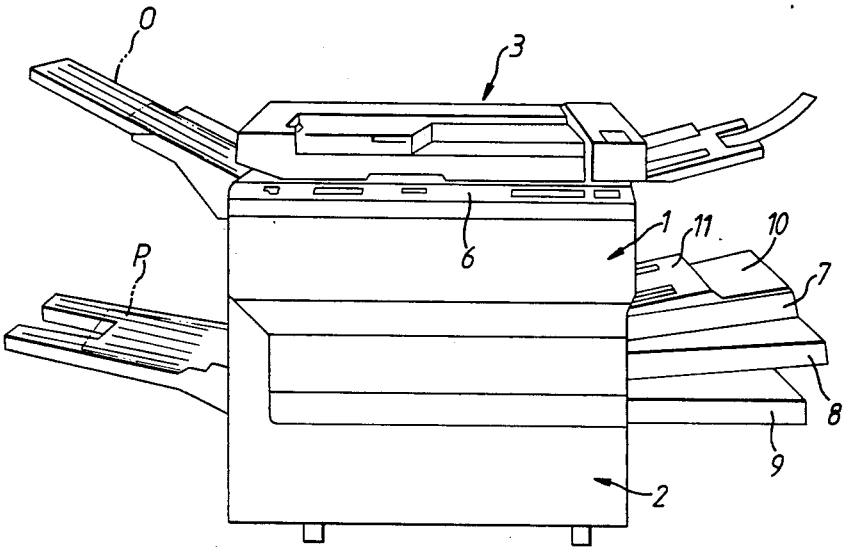
Figure 9:
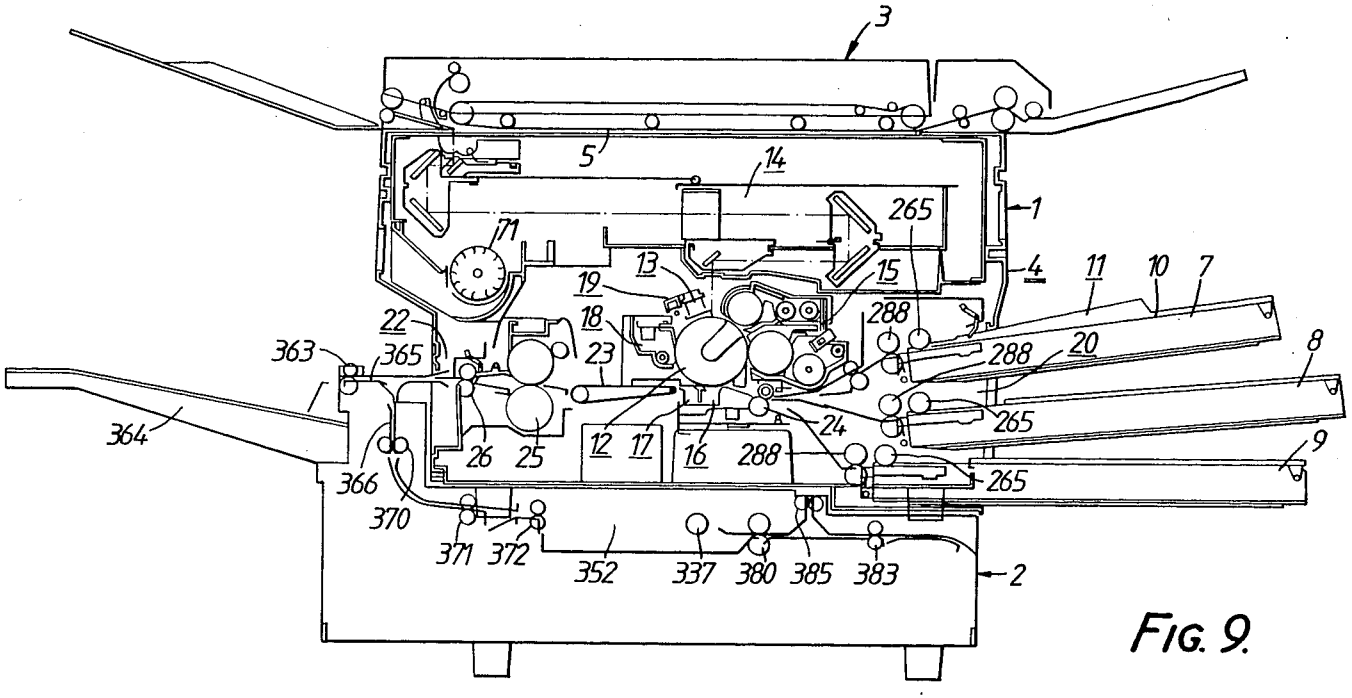

FIG. 8 and FIG. 9 show a copying machine as an example of an image formation apparatus in which a display device according to the invention may be employed. Element 1 is a copying machine main body and Element 2 is a direction-change unit by which, depending on requirements, copy paper P fed out from a feed-out section of copying machine main body 1 can be received and can be returned again to copying machine main body 1, either as is or after it has been turned upside down, so as to permit multiple image formation thereon or formation of images on both sides thereof and which also serves as a support for copying machine main body 1. Element 3 is an automatic original document feed unit which effects automatic supply of original documents 0 onto the upper surface of copying machine main body 1.

Figure 10:
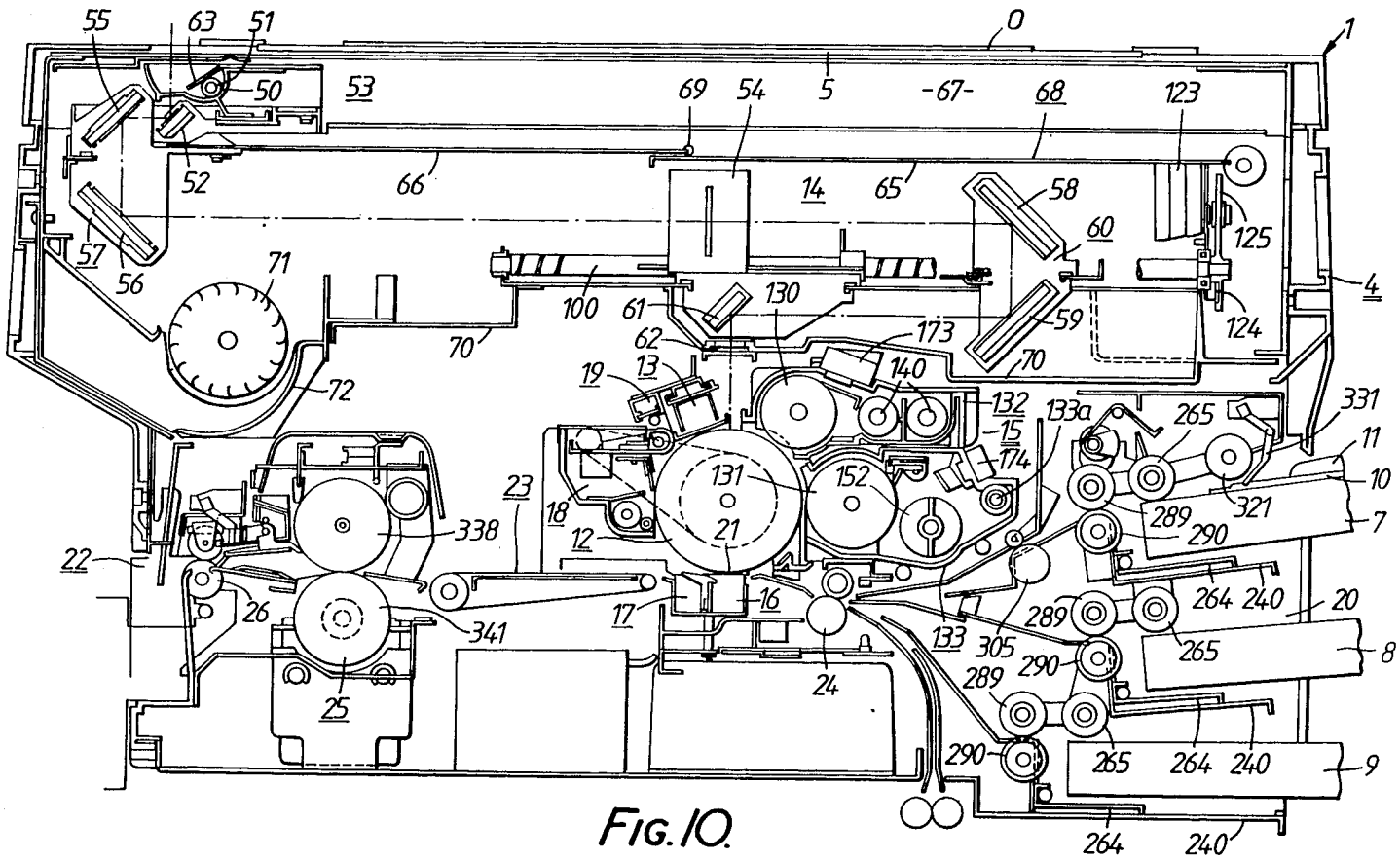

Copying machine main body 1 has a construction as shown in FIG. 10. A housing 4 is provided having an upper surface which receives an original document support 5 for carrying an original document 0 supplied by automatic original document feed unit 3 and at the upper-surface front edge portion of which a control panel 6 is provided, which will be described below with reference to FIG. 1. Paper supply cassettes 7, 8 and 9 are fitted on a right-hand surface portion of housing 4. The cassette cover 10 of upper-stage paper supply cassette 7 defines a manually inserted paper supply block 11 for supply of copy paper P by appropriate manual insertion. A photosensitive drum 12 is disposed in a generally central portion of housing 4, add a charging unit 13, optical exposure apparatus 14, a two-color development apparatus 15 that is described below, a transfer unit 16, a peel-off unit 17, a cleaning unit 18 and a residual image removal unit 19 are successively disposed around the periphery of photosensitive drum 12. In a lower portion inside housing 4, a copy paper P transport path 23 is defined via which copy paper P supplied from an automatic paper supply unit 20 in which paper supply cassettes 7, 8 and 9 are mounted, copy paper P supplied by manual insertion from manually inserted paper supply block 11 and copy paper P introduced from direction-change unit 2 is led between transfer unit 16 and an image transfer section 21 to a feed-out section 22 provided on a left-hand surface portion of housing 4. Registration rollers 24 are provided on the side of copy paper P path 23 that is upstream of image transfer section 21 and a fixing unit 25 and paper feed-out rollers 26 are provided on the downstream side.

Figure 1:
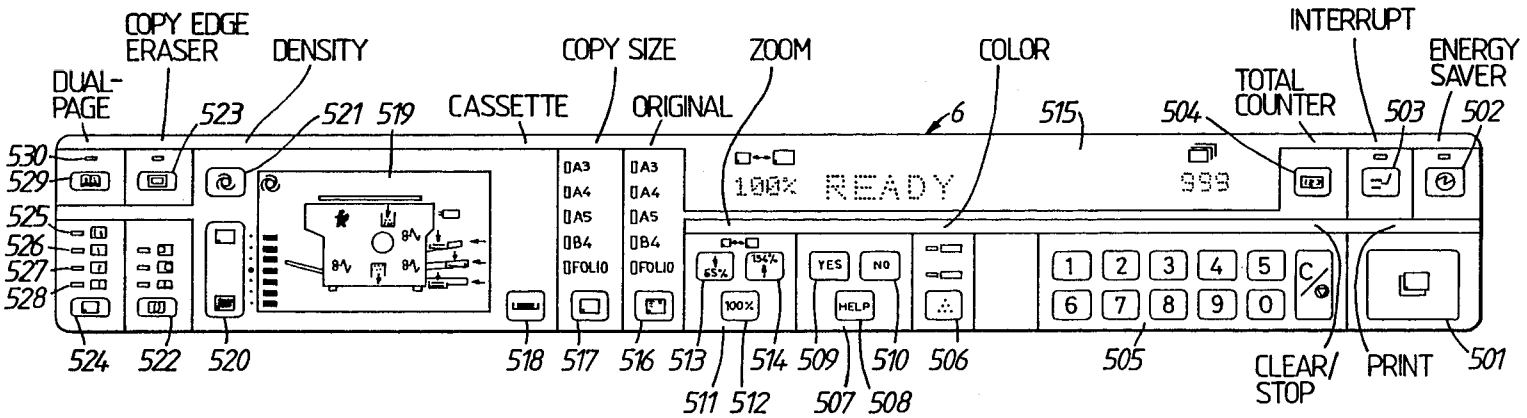

Control panel 6 has a construcion as shown in FIG. 1 and includes a print key 501 for causing execution of photocopying operation, an energy saver key 502 for setting the copying machine in a preheat state, an interrupt key 503 for setting an interrupt mode in order to effect interrupt copying, a total counter key 504 which is depressed when it is required to check the total number of copies, number keys 505 for setting the number of copies, etc., color selection keys 506 for selecting the color of copies, operation guide keys 507 which are depressed when operational procedure is not known, magnification-change keys 511 for setting the degree of magnification of copies and a first display section 515 which gives a message displaying guidance for operation or the copying machine condition and displays the set number of copies and magnification. Operation guide keys 507 consist of a HELP key 508, a YES key 509 and NO key 510, the arrangement being such that when HELP key 508 is pressed, a question appears in 1st display section 509 and the user proceeds to a subsequent step by using YES key 509 or NO key 510 in response to the question. Magnification-change keys 511 consist of an equal magnification (100%) key 512 which is pressed when it is required to set same-size copy magnification, an enlargement (154%) key 513 which is pressed when it is required to increase the copy magnification and a reduction (65%) key 514 which is pressed when it is required to make the copy magnification smaller. Enlargement key 513 and reduction key 514 permit the copy magnification to be set in 1% steps in the range 65%–154%. First display section 515 normally gives a message displaying of the condition of the copying machine. For example, it displays the message "WAIT WARMING UP", "READY", "COPYING" or "REPLENISH PAPERS" in correspondence to the status at that particular time. If, for example, "READY" is displayed, a set photocopying operation can be effected by specifying the number of copies with number keys 505, specifying the copy magnification with magnification-change keys 511, specifying the copying mode with a mode setting key 524 that is described below, and then pressing copy key 501.

An original document size key 516 specifies the original document size, a copy paper size key 517 selects the copy paper size, a cassette selection key 518 selects the lower cassette, a second display section 519 indicates a copying machine malfunction, etc., manual exposure keys 520 set the copy density manually, an automatic exposure key 521 automatically sets the copy density, a margin shift key 522 is pressed when a binding margin is needed and an edge eraser key 523 is pressed when a blank space is required in a copied image. A mode setting key 524 is provided for setting the copying mode. Depression of mode setting key 524 causes mode display lamps 525–528 to light up in succession and changes the copying mode. Mode display lamp 525 is a display lamp for a double copy mode in which first and second copies are superimposed on the surface of a single sheet of copy paper. Mode display lamp 526 is a display lamp for a single original document, both-side copying mode in which a first copying operation is effected on the top side of a sheet of copy paper and a second copying operation is effected on the rear side of the same sheet. Mode display lamp 527 is a display lamp for two original documents, both-side copying mode in which two original documents are set on original document support 5, the first original document is copied on the top side of a sheet of copy paper and the second original document is copied on the rear side of the same sheet of copy paper. Mode display lamp 528 is a display lamp for a two-side book copying mode in which the first page of a book is copied on the top surface of a first sheet of copy paper, the second page is copied on the top side of a second sheet of copy paper and the third page is copied on the rear side of the second sheet of copy paper. There is also a book copying mode key 529 and a book copying mode display lamp 530. In this mode, the first page of a book is copied on the top surface of a first sheet of copy paper and the second page is copied on the top surface of a second sheet of copy paper.

Figure 11:
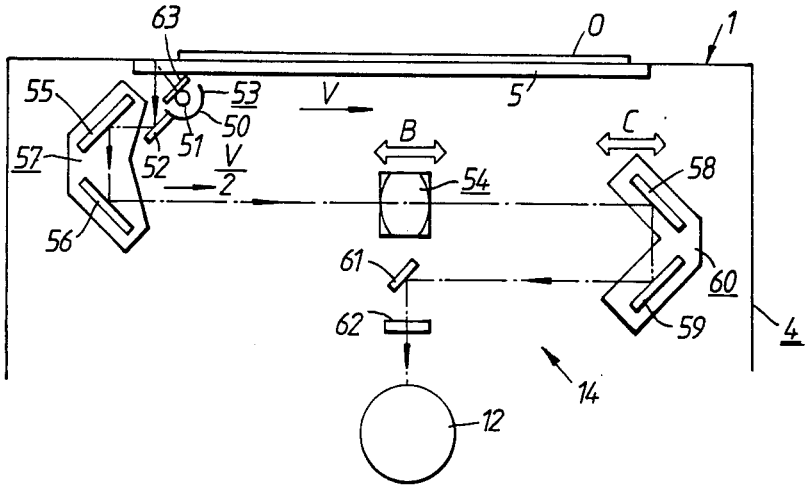
Figure 12:
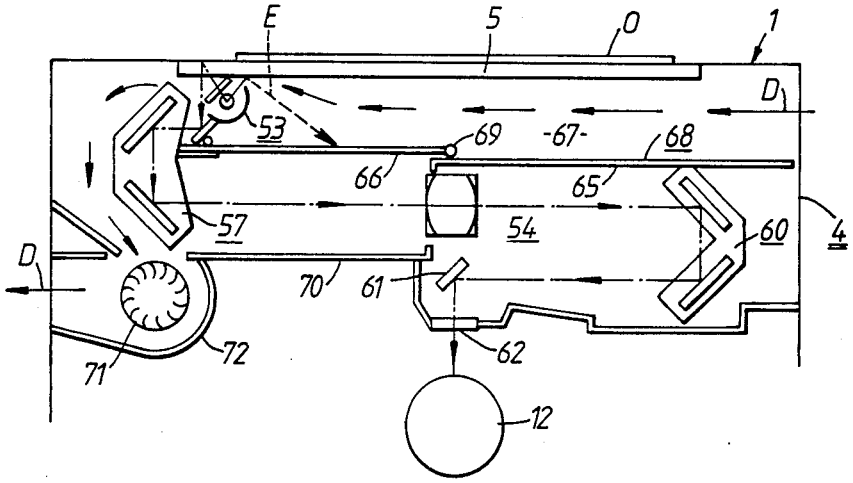

Optical exposure apparatus 14 has a construction as shown in FIG. 11 and FIG. 12 and includes an exposure lamp 51 whose rear portion is surrounded by a reflector 50 and which radiates light onto an original document 0 on original document support 5, a first mirror 52 by which light reflected from original document 0 is reflected in a set direction, a first optical unit 53 which is movable in parallel to the lower surface of original document support 5, a second mirror 55 which moves synchronously with first optical unit 53 and in the same direction as first optical unit 53 but at half its speed and by which an optical image reflected from first optical unit 53 is reflected towards a lens unit 54 and a second optical unit 57 including a third mirror 56. The structure further comprises, in the stage to the rear of lens unit 54, a third optical unit 60 including a fourth mirror 58 and a fifth mirror 59 and a fixed sixth mirror 61 by which an optical image reflected from third optical unit 60 is reflected towards photosensitive drum 12. An anti-dust glass 62 is provided between sixth mirror 61 and photosensitive drum 12, and a heat ray absorption glass 63 is provided in front of exposure lamp 51.

With exposure lamp 51 lit, first optical unit 53 moves at a speed V parallel to original document support 5 and second optical unit 57 moves in synchrony with this movement in the same direction but at a speed that is half of speed V, whereby an original document 0 on original document support 5 is scanned, an image is focussed on photosensitive drum 12, which is already rotating, and an electrostatic latent image corresponding to original document 0 is formed on photosensitive drum 12, which has been uniformly charged by charging unit 13.

The electrostatic latent image thus formed is developed by being brought opposite development apparatus 15, following which it is brought into image transfer section 21 facing transfer unit 16 and the developer image is transferred onto copy paper P that has been supplied via registration rollers 24. Next, the copy paper P onto which an image has been transferred is peeled off photosensitive drum 12 by peel-off unit 17 and then it is led along transport path 23 to fixing unit 25, where the image is fixed, and fed out via feed-out rollers 26 to feed-out section 22. Meanwhile, following transfer of the developer image onto the copy paper P, the surface of photosensitive drum 12 has residual developer (toner) cleaned off by being brought opposite cleaning unit 18, and then any residual image is removed by residual image removal unit 19, so allowing the next copying operation to take place.

As described more fully below, lens unit 54 and third optical unit 60 provided with fourth and fifth mirrors 58 and 59, that are disposed at an angle of 90, are constructed so that they can move in the manner indicated by the arrows B and C in FIG. 11, so as to permit alteration of the object distance and the distance between the lens and the image formation plane.

As shown in FIG. 10 and FIG. 12, a first shielding element 65 is provided which is disposed so that it covers the upper surfaces of lens unit 54 and third optical unit 60 and also serves as a lens cover. Second optical unit 57 is provided with second shielding element 66 in a disposition such that it partially overlaps first shielding element 65. Above first and second sshielding elements 65 and 66, a partitioning means 68 is defined which effects partitioning such that a cooling air guideway 67 is defined along original document support 5. The mounted end of second shielding element 66 is guided on the top of first shielding element 65 by a support means 69 which is a roller or a slide element. Thus, there is no need for a special guide means.

The plane below second optical unit 57, lens unit 54 and third optical unit 60 is covered by a partition board 70 which supports a portion of anti-dust glass 62 and has one end connected to the fan casing 72 of a ventilation fan 71, whereby housing 4 is divided into generally upper and lower portions.

As indicated by arrows D in FIG. 12, the action of ventilation fan 71 results in cooling air being directed into cooling air guideway 67 from the right-hand side surface of housing 4, being guided steadily by first shielding element 65 and second shielding element 66 along the lower side of original document support 5 to a left-hand surface portion, after which it is evacuated to the exterior. This permits satisfactory cooling of exposure lamp 51 and extends the life of exposure lamp 51 by preventing it from overheating and at the same time minimizes adverse effects of heat on other parts. Also, the whole area of original document support 5 is cooled so that the operator does not feel uneasy. Further, image faults caused by stray light entering lens unit 54 are effectively prevented, since stray light is shut out by second shielding element 66, as indicated by arrow E.

Figure 13:
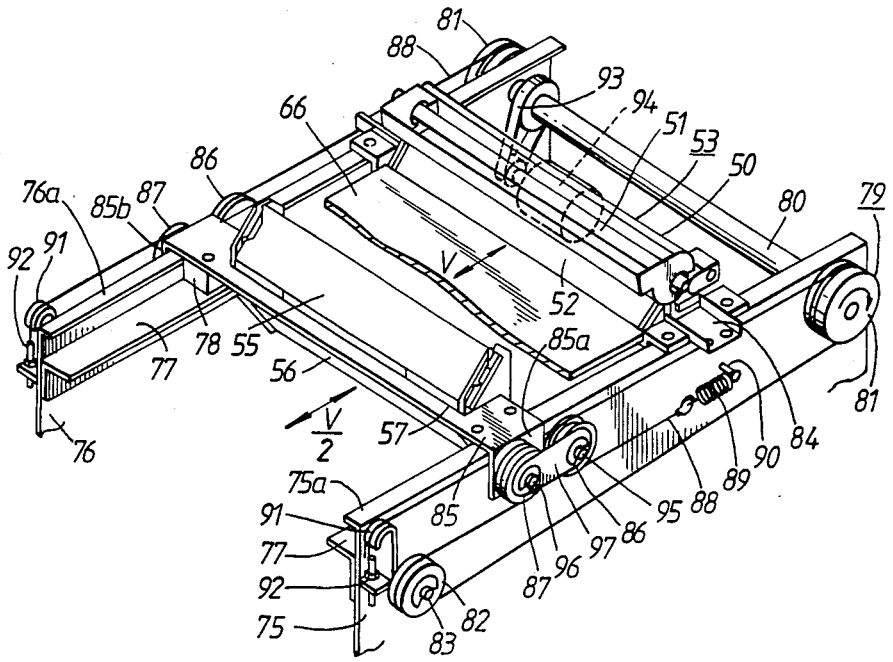

First optical unit 53 and second optical unit 57 are mounted and supported in the manner as shown in FIG. 13, in a structure permitting displacement of first optical unit 53 at a speed V and second optical unit 57 at a speed that is half of speed V. More particularly, guide frames 77 and 77 are mounted parallel to upper-edge horizontal sections **75*a* and 76*a* on mutually opposed side surfaces of a rear frame 75 and front frame 76 that are spaced but aligned with one another. First optical unit 53 and second optical unit 57 are mounted so as to extend between side frames 77 and 77, with siders 78, fitted on the lower surface of their opposite ends in sliding contact with the tops of guide frames 77 and 77. First optical unit 53 and second optical unit 57 that are thus mounted in a manner permitting them to move freely and can be moved at set speeds in set directions by an optical unit actuation mechanism 79. The construction of optical unit actuation mechanism 79 is as follows. At one end going in the direction of displacement of first and second optical units 53 and 57, drive shaft 80 is mounted crossways facing this end and has drive pulleys 81 and 81 mounted on its opposite ends, which are on the outsides of frames 75 and 76. The outer sides of frames 75 and 76 at the end corresponding to the other end in the direction of first and second optical unit 53 and 57 have follower displacement of pulleys 82 rotatably supported on them by support shafts 83. Opposite end portions of the carriage 84 of first optical unit 53 project to the outside of frames 75 and 76, while the opposite end portions of the carriage 85 of second optical unit 57 have pulley mounting portions 85a and 85b that are bent over vertically and lie alongside the outer surfaces of frames 75 and 76 and are each fitted with a pair of pulleys 86 and 87 that serve as running blocks. Intermediate portions of wires 88 are passed around and between the various pulleys 81, 82, 86 and 87 in a set manner. More particularly, each wire 88 has one end fixed to a fixed element 90 via a spring 89, is led towards the follower pulley 82 end, wound around first pulley 86 of second optical unit 57 and doubled back, then wound several times around drive pulley 81 and doubled back again towards follower pulley 82, passed around follower pulley 82 and then passed around second pulley 87 of second optical unit 57, after which it goes round a guide 91 and has its other end fixed to a fixed element 92. Wires 88 are fixed directly to opposite ends of carriage 84 of first optical unit 53**.

Figure 14:
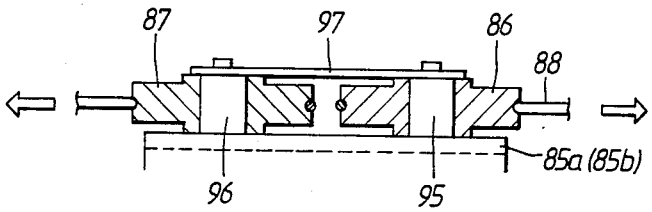

Drive shaft 80 is connected to a stepping motor 94 via a timing belt 93, so as to permit drive pulleys 81 and 81 around which wires 88 are wound to be driven in a forward direction or a reverse direction. The construction is also such that first optical unit 53 to which wires 88 are directly fixed is moved at a speed V and second optical unit 5 fitted with pulleys 86 and 87 which have wires 88 passed around them and serve as running blocks is moved at a speed that is half of speed V. As can be see from FIG. 14, the pairs of pulleys 86 and 87 mounted on each end of second optical unit 57 are mounted on independently disposed support shafts 95 and 96 on a line parallel to the direction of second optical unit 57 movement, i.e., in a direction parallel to the direction of the wire 88 pulling force, the arrangement thus being one in which there is no moment acting in a direction normal to the direction of the wire 88 pulling force and in which a stable support state can be maintained for a long time without vibration. A connecting reinforcement element 97 is provided which connects the free ends of support shafts 95 and 96 on which pulleys 86 and 87 are rotatably mounted.

Changing the copy magnification in the manner noted above means that it must be psssible to effect set amounts of displacement of lens unit 54 and third optical unit 60 fitted with fourth and fifth mirrors 58 and 59 disposed at an angle of 90°. The amounts of displacement are noted in the following table if, for example, a lens with a focal distance f of 210 mm is used.

| Magnification | Amount of lens displacement (mm) | Amount of mirror displacement (mm) |
|---|---|---|
| 0.17× (A3 → A4) | 85.8 | 12.4 |
| 0.82× (B4 → A4) | 46.1 | 4.1 |
| 1.00× (same size) | 0 | 0 |
| 1.41× (A4 → A3) | −16.1 | 12.5 |

Movement approaching the third optical unit is (−), movement away is (+).

Figure 15:
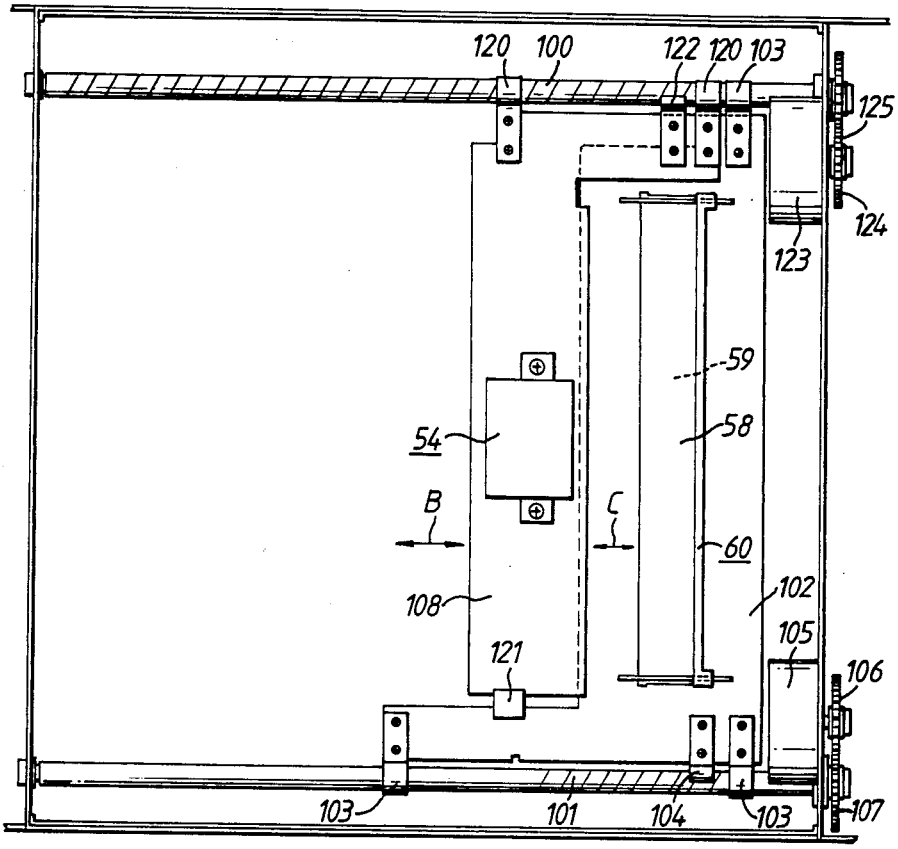

Lens unit 54 and third optical unit 60 are mounted and supported in the manner shown in FIG. 15 so that lens unit 54 can be moved and third optical unit 60 also can be moved, but with its displacement less than that of lens unit 54, so as to give a set copying magnification. More particularly, a pair of screwshafts 100 and 101 is rotatably mounted on either side of and parallel to the path of movement of units 54 and 60, and third optical unit 60 is supported so that it is free to slide on screwshafts 100 and 101 by slide bushes 103, which are mounted on opposite ends of a carriage 102 and fit around screwshafts 100 and 101. One end of carriage 102 has a spiral housing 104 mounted thereon which is engaged on screwshaft 101, whereby forward and reverse rotation of screwshaft 101 is accompanied by reciprocal movement of third optical unit 60, guided by screwshafts 101 and 100. The drive force of a stepping motor 105 for mirror drive is transmitted to screwshaft 101 via a set of gears 106 and 107. The carriage 108 of lens unit 54 is slidably supported by having a first end supported by slide bushes 120 and 120 on screwshaft 100, while a slide 121 mounted underneath its other end is set directly on top of carriage 102 of third optical unit 60. The first end of carriage 108 also has mounted thereon a spiral housing 122 that is engaged on screwshaft 100 and moves reciprocally in accompaniment to forward and reverse rotation of screwshaft 100, which is supplied with the drive force of a stepping motor 123 for lens drive via a set of gears 124 and 125.

Thus, third optical unit 60 is moved a set distance in a set direction by forward or reverse rotation of mirror drive stepping motor 105 and lens unit 54 is moved a set distance in a set direction by forward or reverse rotation of lens drive stepping motor 123. During this process, the amount of displacement per unit time of third optical unit 60 is made less than that of lens unit 54 by altering the frequencies of the drive pulses of mirror drive stepping motor 105 and lens drive motor 123. Because with a given amount of displacement of lens unit 60 and third optical unit 54, third optical is responsible for a greater change in focusing and magnification, high positioning precision is achieved by effecting slow movement so as to avoid undesirable effects of inertia, etc.

Figure 16:
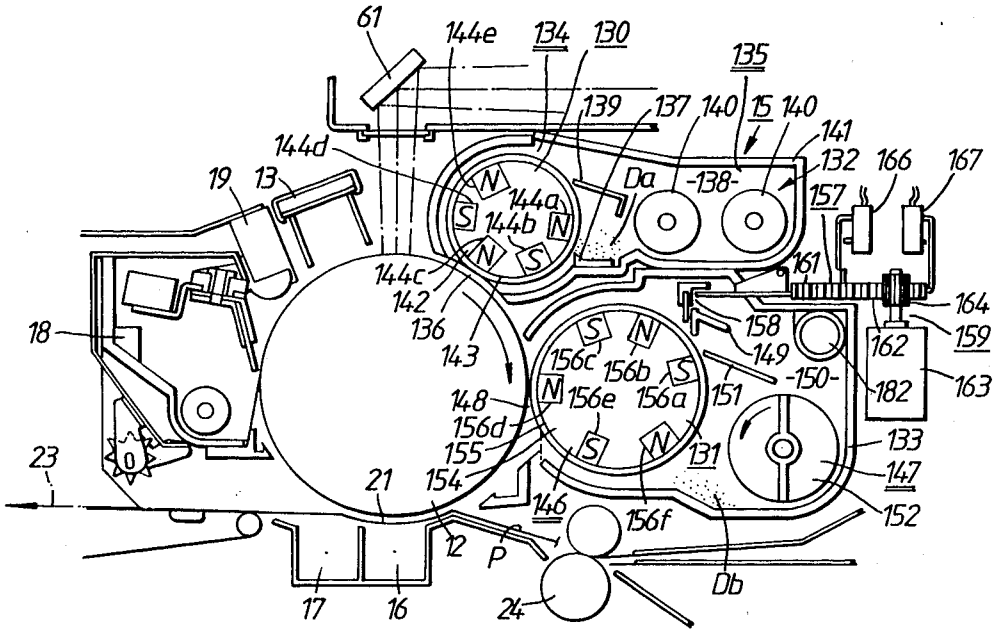
Figure 17:
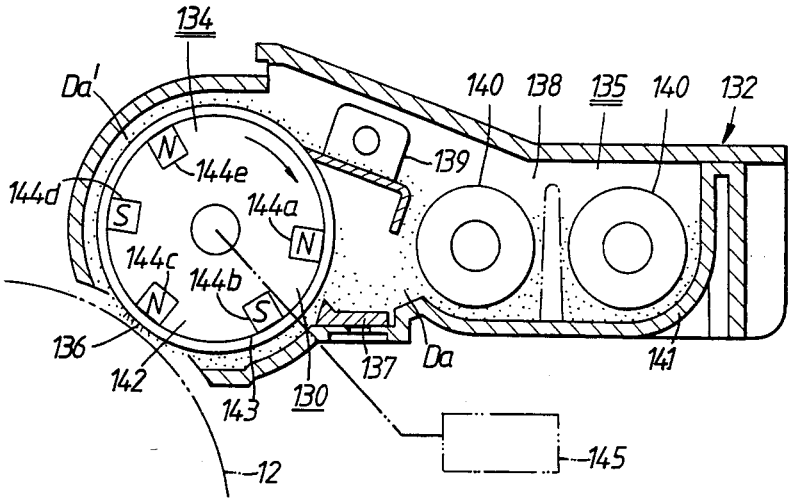

Development apparatus 15 has a construction as shown in FIG. 16 through FIG. 22. As shown in FIG. 16, apparatus 15 comprises a first development roller 130 and a second development roller 131 which are selectively driven so as to effect, for example, black or red development. Development apparatus 15 is divided into two sections, a first development unit 132 comprising first development roller 130 and a second development unit 133 comprising a second development roller 131. First development unit 132, which is at a higher level employs less frequently used red developer Da, while second development unit 133, at a lower level, employs black developer Db, which is used more frequently. Developers Da and Db are two-component developers consisting of a toner and a carrier.

Figure 18:
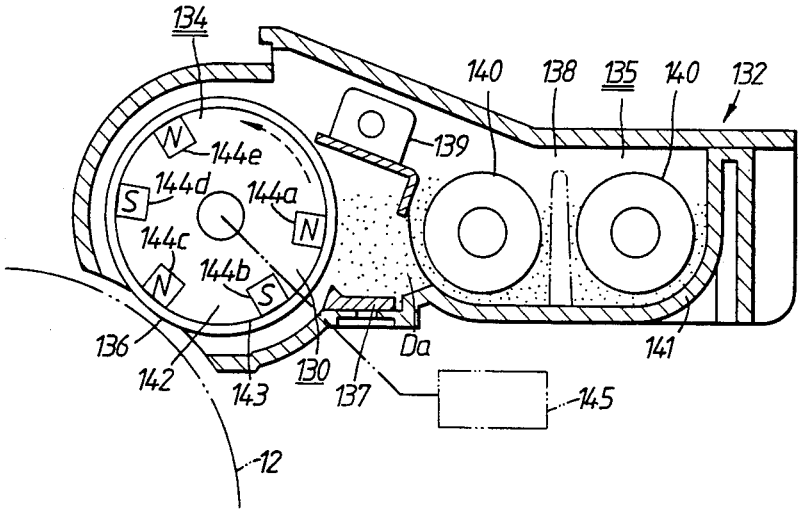
Figure 19:
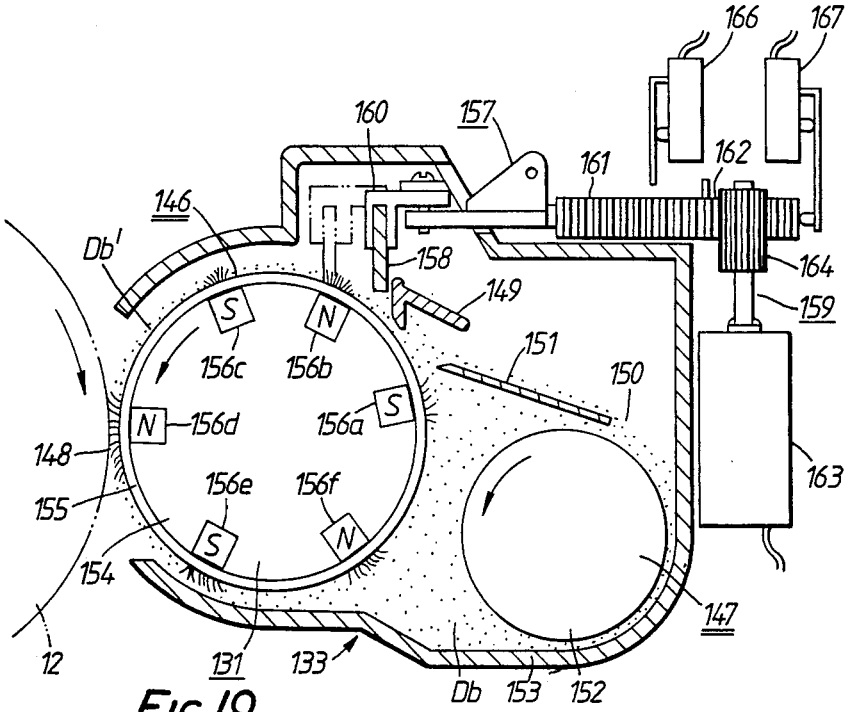

As shown in FIGS. 18 and 19, first develoment unit 132 employing a red developer Da consists of a mechanical development section 134 and a developer mixing section 135 and has a structure in which first development roller 130, a doctor 137 which regulates the thickness of a magnetic developer brush Da' formed on the surface of first development roller 130 and is located upstream of the location where the magnetic developer brush Da' is in sliding contact with photosensitive drum 12, i.e., upstream of the development station 136, a scraper 139 which is located downstream of the development station 136 and scrapes off the magnetic developer brush Da' present on the surface of first development roller 130 and guides it into a developer receptacle 138 and mixers 140 and 140 that are accommodated in developer receptacle 138 are housed in a casing 141. First development roller 130 has a construction in which a sleeve 143 is fitted on a magnetic roller 142 that has five pole pieces 144a–144e, the first, third and fifth pole 144a, 144c and 144e pieces being N poles and the second and fourth pole pieces 144b and 144d being S poles. Pole pieces 144a–144e are arranged at angles of approximately 50–70 and the magnetic force distribution is 700–1000 gauss at third pole piece 144c, which is opposite the development station, and 300–600 gauss at the other pole pieces 144a, 144b, 144d and 144e.

Development is effected in first development unit 132 by rotary sleeve 143 rotating clockwise as seen in the drawings in a so-called counter mode in which the developer brush Da' held on its outer surface is brought into sliding contact in the direction counter to the flow of the image on photosensitive drum 12, so as to result in development of the electrostatic latent image on photosensitive drum 12. The area from the exposure station to the transfer station is kept to a minimum, and the copying machine is made more compact, by making first development roller 130 a small diameter roller.

As the diameter of photosensitive drum 12 in the invention is 78 mm, it only about 122 mm form the exposure station to the transfer station going along the periphery. Making the development station, i.e., the space between the exposure station and the transfer station, larger would necessitate making the charging unit 13 and cleaning unit 18 still smaller, and there are limits to this. Because of this, it has been determined that it is possible in terms of space to install a developer if it is one in which the diameter of first development roller 130 is 40 mm or less. There are also restrictions on the height of first development unit 132 and of second development unit 133, and we found that with a photosensitive drum 12 diameter of 78 mm the height must be 120 mm or less. In other words, both first development unit 132 and second development unit 133 must be thin. It is for this reason that counter mode developers are commonly used, which make effective use of space in the direction of height and which are also low-cost since they have a small number of poles. First development unit 132, in particular, being located in an upper section, a follower mode, for which the developer's opening section faces downwards and developer Da flows downwards from above, would give rise to problems of spillage and dropping of developer Da. In this respect too, the counter mode is advantageous for first development unit 132 in the upper section.

The magnetic developer brush Da' on rotary sleeve 143 is removed by a developer removal means 145 in first development unit 132. Developer removal means 145 is a very simple and low-cost system, as illustrated in FIG. 18. Removal is effected simply by rotating rotary sleeve 143 in the opposite direction (counterclockwise) to the direction for development. On completion of transfer, rotary sleeve 143 is rotated in reverse, thus reversing the direction of transport of developer Da, and, as a result, all the developer Da is gathered between doctor 137 and scraper 139, as illustrated in FIG. 18.

It is preferable for the number of poles to be five or less, since the further apart first pole piece (carrier pole) 144a and fifth pole piece (carrier pole) 144e are, the more efficiently the transport and non-transport of developer Da can be controlled.

The tip end of scraper 139 is fitted with a thin flexible plate element (not shown) such as Mylar (trade name), etc. in contact with rotary sleeve 143 in order to improve reverse developer Da transport prevention effects. The rotary sleeve 143 reverse rotation operation, i.e., the magnetic developer brush Da' removal operation, is not only effected after completion of a development operation (after completion of a transfer operation) but is also effected after an unforeseen stoppage of the apparatus. That is, if a sudden stoppage of the apparatus occurs because the power is cut or copy paper becomes jammed, etc., when, subsequently, steps have been taken to restore the power or remove the paper, etc., the optical system of optical exposure apparatus 44, etc. are restored to the initial state and at the same time reverse rotation is effected again. Thus, the arrangement is such that there is never any developer Da on rotary sleeve 143, at least in the vicinity of development station 136, in the "Copying possible" state, i.e., when the apparatus is ready for use.

Apart from changing the direction of rotation of rotary sleeve 143, another method of controlling forward transport and non-forward transport of developer Da when rotary sleeve 143 has a diameter of about 40 mm or less and a width of about 230 mm or less is to cause rotational displacement of magnetic roll 142 by means of a solenoid or similar drive source to bring first pole piece 144a opposite doctor 137 which is a non-magnetic element.

Second development unit 133 which uses black developer Db consists of a mechanical development section 146 and a developer mixing section 147, as shown in FIGS. 18 and 19. Unit 133 has a second development roller 131. Second development roller 131 consists of a magnetic roller 154 and a rotary sleeve 155 that fits around magnetic roller 154 and rotates counterclockwise as seen in the drawings. A doctor 137 is also provided which regulates the thickness of magnetic developer brush Db' formed on the surface of second development roller 131 and is located upstream of the location where the magnetic developer brush Db' is in sliding contact with photosensitive drum 12, i.e., upstream of the development station 148. A guide 151 by which developer Db scraped off by doctor 149 is guided to a developer receptacle 138 and a developer mixer 152 that is accommodated in developer receptacle 138 are further provided. Unit 133 is housed in a cssing 153.

Second development roller 131 in second development unit 133 is made larger than first development roller 130 so as to permit high-speed development. Development is effected by rotating rotary sleeves 155 counterclockwise as shown in the drawings, in so-called following mode, in which a sufficient development time is ensured and an electrostatic latent image formed on photosensitive drum 12 is developed as a high quality image by causing the magnetic developer brush Db' held on the surface of rotary sleeve 155 to come into sliding contact with photosensitive drum 12 following the direction of flow of the image on photosensitive drum 12.

Magnetic roll 15 has six pole pieces 156a–156f, or one more than first development roller 130, to make it adapted to follower mode operation. The second, fourth and sixth pole pieces 156b, 156d and 156f are N poles and the first, third and fifth pole pieces 156a, 156c and 156e are S poles. Pole pieces 144a–144e are arranged at angles of approximately 50–60 and the magnetic force distribution is 800–1000 gauss at fourth pole piece 156d, which is opposite the development station, and 400–600 gauss at the other pole pieces 156a, 156b, 156c, 144e and 156f.

Figure 20:
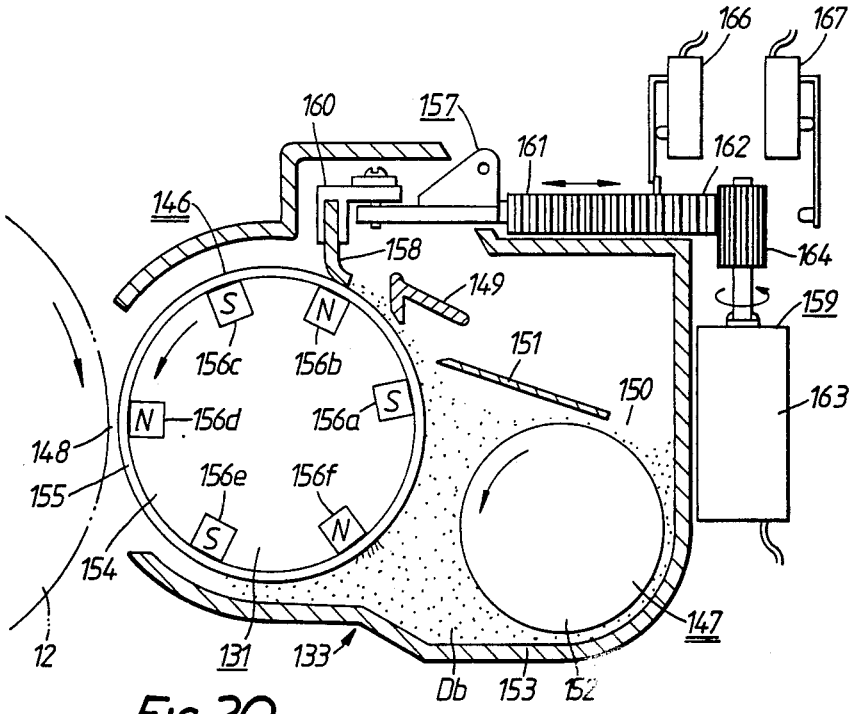
Figure 21:
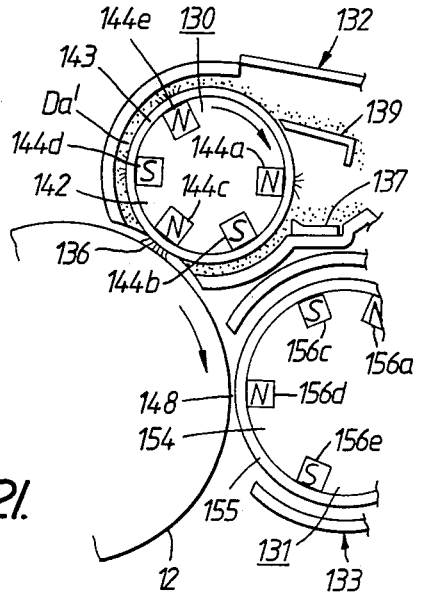

The magnetic developer brush Db' on rotary sleeve 155 in second development unit 133 is removed by a developer removal means 157 which, as shown in FIGS. 19 and 20, consists of a blade 158 constituted by a flexible element of urethane rubber, etc. and a blade moving mechanism 159 for moving blade 158 horizontally, which is arranged so that blade 158 can be pressed against the outer surface of rotary sleeve 155 so as to prevent developer Db being carried to development station 148. Blade moving mechanism 159 is provided by causing a pinion 164 that is driven by a motor 163 to engage a rack 162 provided on a slider 161 integral with a blade holder 160. Forward and reverse rotation of motor 163 causes slider 161 to advance and retreat, so as to alternately bring blade 158 into contact with the surface of photosensitive drum 12, as shown in FIG. 20, and separating it from the surface of photosensitive drum 12, as shown in FIG. 21. The position at which blade 158 comes into pressure contact with photosensitive drum 12 lies between the location of doctor 149 and second pole piece (carrier pole **156*b*. This is because although the location of second pole piece 156*b* is the most efficient for scraping off magnetic developer brush Db', if the interval between blade 158 and doctor 149 is large, the amount of developer Db gathering in the interval between these two elements becomes large and when the next copying operation is effected, as photosensitive drum 12 rotates, the developer Db that has gathered in this interval is scraped off and fouls the interior of the machine. The position of pressure contact of blade 158 is therefore made one where scrape-off can be effected with good efficiency leaving little accumulation of developer Db, which position is between doctor 149 and second pole piece 156*b*. Position detectors 166 and 167 detect when slider 161 is in an advanced position and when it is in a retracted position and their detection signals serve to stop motor 163**.

Following completion of a transfer operation, blade 158 is in contact with rotary sleeve 155 as shown in FIG. 20, immediately prior to stopping of rotary sleeve 155, but then, after rotary sleeve 155 has rotated half a turn or more and stops, blade 158 is separated from rotary sleeve 155 as shown in FIG. 19. As a result, developer Db is removed from at least the portion of rotary sleeve 155 that is at the development station. As with first development unit 132, described above, the blade 158 contact action, i.e., the magnetic developer brush Db' removal action, is not only effected after completion of a development operation (after completion of a transfer operation) but is also effected after an unforeseen stoppage of the apparatus. That is, if a sudden stoppage of the apparatus occurs because the power is cut or copy paper becomes jammed, etc., when, subsequently, steps have been taken to restore the power or remove the paper, etc., the optical system of optical exposure apparatus 14, etc. are restored to the initial state and at the same time the blade 158 contact action is effected again. Thus, the arrangement is such that there is never any developer Db on rotary sleeve 155, at least in the vicinity of development station 148, in the "READY" state, i.e., when the apparatus is ready for use.

First and second development units 132 and 133 thus provided are selectively activated by commands from a color specification section. If red is designated, a magnetic developer brush Da' is formed only on rotary sleeve 143 of first development unit 132, as in FIG. 21, and if black is designated, a magnetic developer brush Db' is formed only on rotary sleeve 155 of second development unit 133, as in FIG. 22.

If the designation given is such that first development unit 132 is actuated, rotary sleeve 143 of first developing roller 130 rotates clockwise as indicated in FIG. 21 and a magnetic developer brush Da' is formed on its outer surface. Then, a previously formed electrostatic latent image on photosensitive drum 12 is developed by red developer Da. On completion of this development of the electrostatic image, development removal means 145 is actuated and rotary sleeve 143 is rotated backwards, as described above, so that at least the developer Da at development station 136 is removed, in preparation for the next development operation. As no magnetic developer brush Db' is formed on rotary sleeve 155 of second development unit 133 at this time, there are no problems with colors being mixed, etc. irrespective of which development units 132 and 133 are designated next time.

Figure 22:
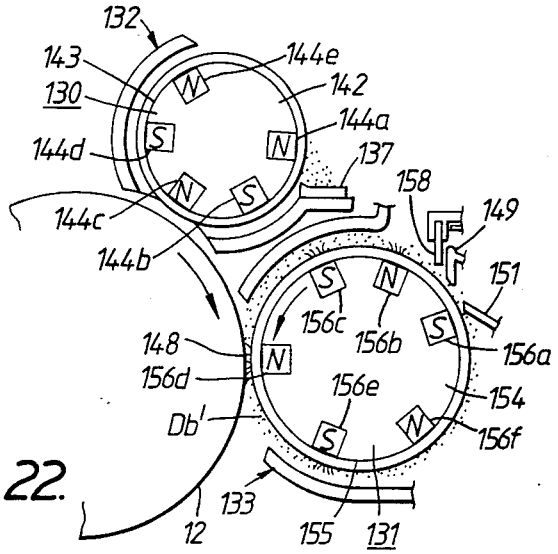

If the designation given is such that second development unit 133 is actuated, rotary sleeve 155 or second developing roller 131 rotates counterclockwise as indicated in FIG. 22 and a magnetic developer brush Db' is formed on its surface. Then, black developer Db develops an electrostatic latent image that has been previously formed on photosensitive drum 12, which is controlled so that it is rotating faster than for development by first development unit 132, so as to permit high speed copying. On completion of this development, developer removal means 157 is actuated in the manner described above and blade 158 is brought into pressure contact with the surface of rotary sleeve 155, so that at least the developer Db at development station 148 is removed, in preparation for the next development operation. The process speed is fast during black copying but is slow during color (red) copying so as to improve the image quality during color copying.

In black copying, i.e., in development by second development unit 133, the rate is made a photosensitive drum 12 peripheral speed of 223 mm/s and 35 sheets/min for A4 crosswise, but in color copying, i.e., in development by first development unit 132, the rate is changed to a photosensitive drum 12 peripheral speed of 136 mm/s and 25/min for A4 crosswise. At 38 mm, as opposed to the 50 mm of second developing roller 131, the diameter of first developing roller 130 is small, but high quality color images can be produced by arranging the components so that a sufficient development time is ensured. Also, it is possible to effect fast copying for copying in black, which is used very frequently.

Figure 23:
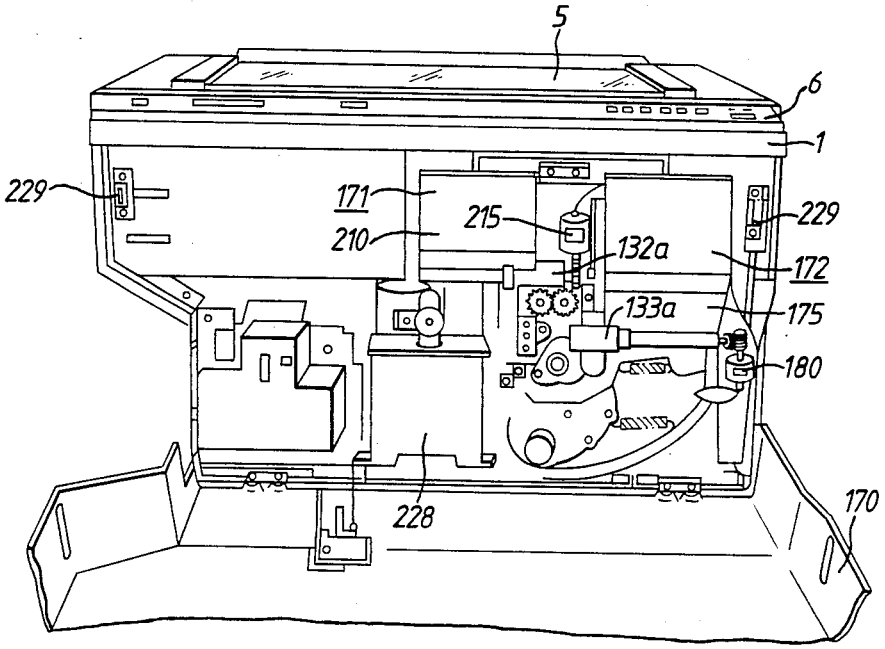

As shown in FIG. 23, front cover 170 is removed so that developer reception and transport sections **132*a* and 133*a* that are exposed and project from first and second development units 132 and 133. Cartridge-type supplementary developer supply units 171 and 172 can be detachably mounted so that they connect with developer reception and transport sections 132*a* and 133*a*. The arrangement is such that suitable replenishments of developers Da and Da to match the amounts used are made in response to detection signals from developer run-out detectors 173 and 174 (see FIG. 9) which detect the amount of developer (the amount of toner in the developer receptacles 138 and 150**.

Figure 24:
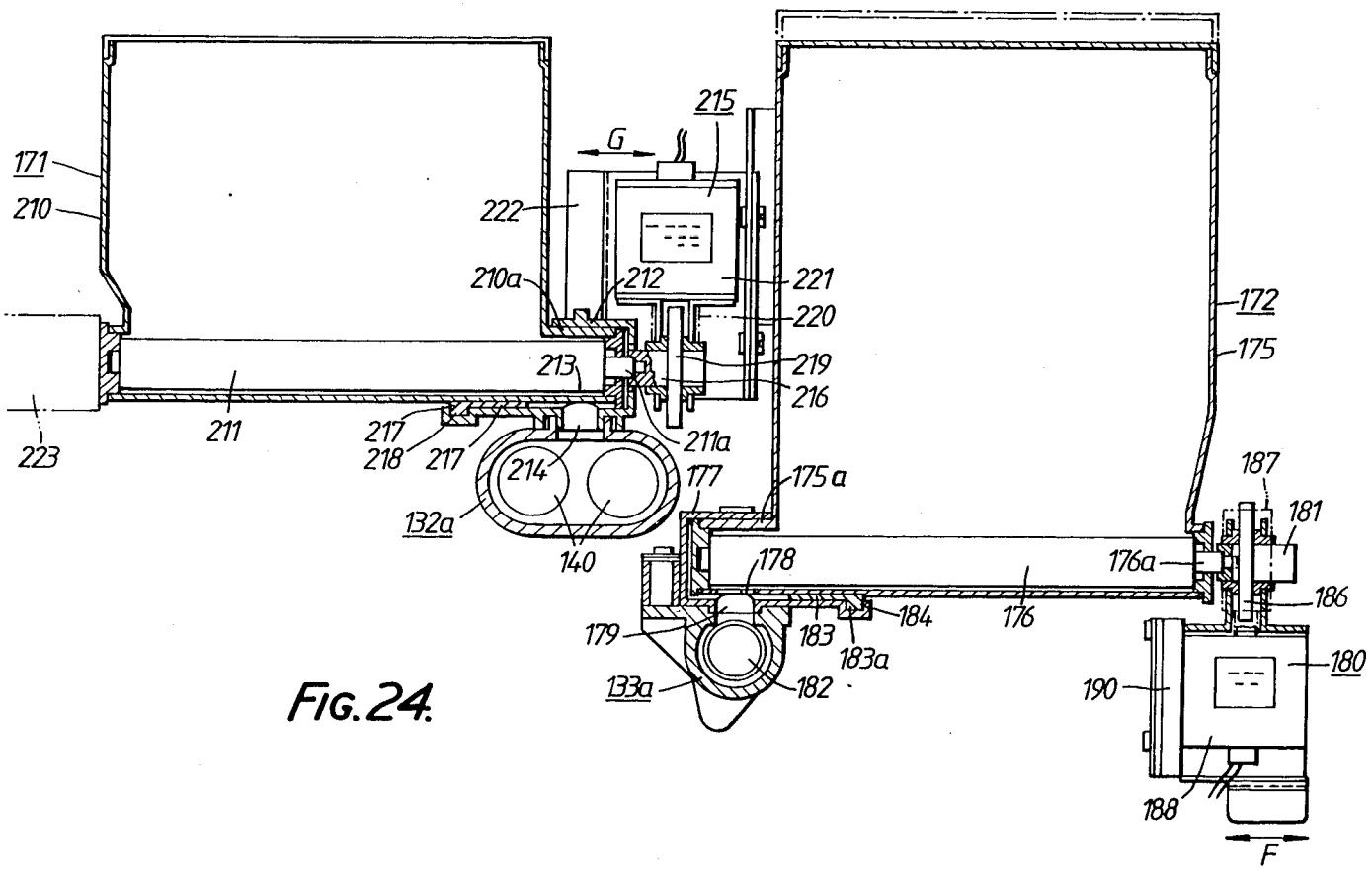

Supplementary developer supply unit 172 for second development unit 133 has a construction, as shown in FIGS. 24 through 27, in which 175 is a container which holds developer Da and in the bottom of which there is a feed screw 176 which feeds developer Db in the axial direction when it is rotatably driven. At the bottom of the side of container 175 towards which developer is moved by feed screw 176, a fitting projection 175a is defined which is detachably insertable into a holder 177. Holder 177 is connected to developer reception and transport section unit 133a and has a lower surface which defines a developer discharge port 178 for discharge of developer Db that has been moved up by feed screw 176. Holder 177 is rotatably mounted on the upper-side surface of developer reception and transport section 133a and its low surface defines a supplementary supply port 179 facing a developer feed shaft (toner auger) 182 of developer reception and transport section 133a. One end of feed screw 176 projects out of an end surface of holder 177 and has a coupling portion 176a which is coupled to a drive coupling 181 of a drive device 180. The underside of fitting projection 175a is fitted with cover 183 that is slidable to open or close developer discharge port 178. A recess 184 is defined in holder 177 which engages a catch projection 183a formed on cover 183 and which, as illustrated in FIGS. 26A and 26B, serves to slide cover 183 to open developer discharge port 178 when fitting projection 175a is inserted into holder 177 and to close it when fitting projection 175a is detached from holder 177. As can be seen in FIGS. 23 and 24, drive device 180 comprises a gear 186 integral with coupling 181, a worm gear 187 meshing with gear 186 and a motor 188 which drives worm gear 187 and is mounted on a movable base 190 that can slide in the directions of arrow F in FIG. 24. Motor 188 is actuated for a set time, and feed screw 176 rotates, in response to a detection signal from developer run-out detector 174, and, as a result, developer Db in container 175 is fed to the developer discharge port 178 side and supplied into supplementary supply port 179 of developer reception and transport section 133a. Next, as developer feed shaft 183 rotates, developer Db that has been supplied through supplementary supply port 179 of developer reception and transport section 133a is carried up into developer receptacle 150.

Figure 27:
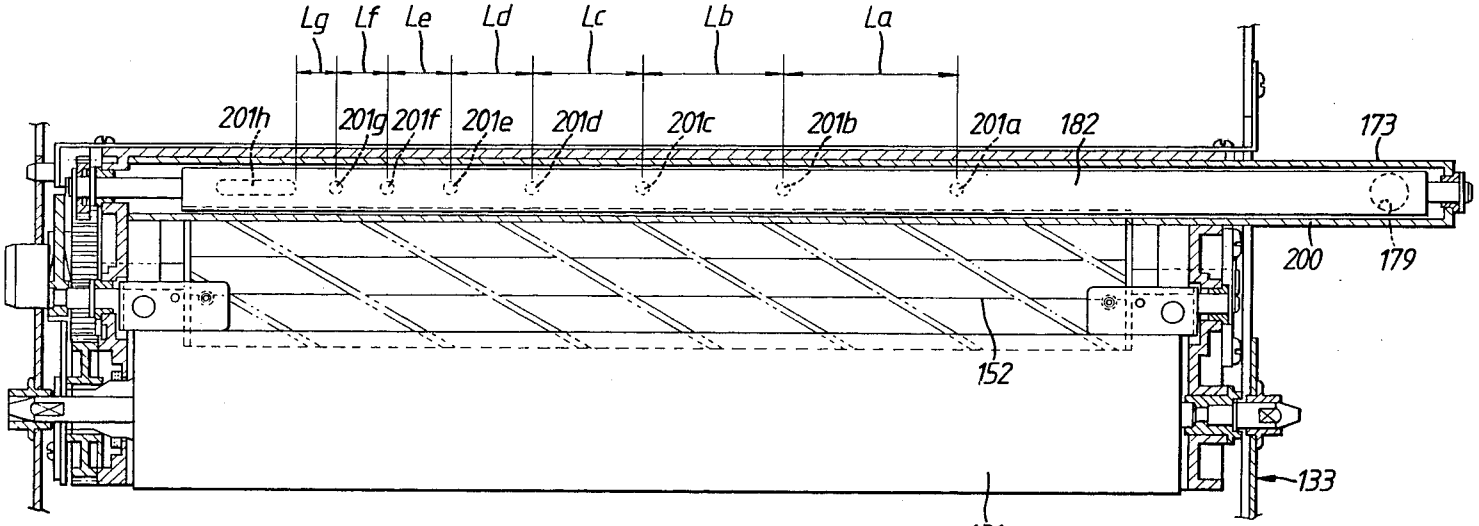

In a bottom portion of a developer guide 200 that encloses developer feed shaft 182, there are developer discharge ports 201a–201h which are provided at intervals La–Lg, as shown in FIG. 27, and serve to effect distribution over more or less the entire axis of developer mixer 152 provided in developer receptacle 152. The intervals La–Lg between developer discharge ports 201a–201h become gradually smaller in the direction of developer feed and the opening area of developer discharge port 201a–201h becomes larger in the developer feed direction, so as to effect uniform distribution of developer Db.

To remove cartridge-type supplementary developer supply unit 172, when there is no more developer Db, etc., first, drive device 180, which is in disposition shown in FIG. 23, is moved to the right, so as to terminate the coupling action between coupling portion 176a of feed screw 176 and coupling 181. Next supplementary developer supply unit 172 as a whole is swung forwards about holder 177 and then fitting projection 175a is extracted from holder 177 by pulling toward one. Mounting a new supplementary developer suplly unit 172 is simply effected by following the reverse procedure.

Figure 25:
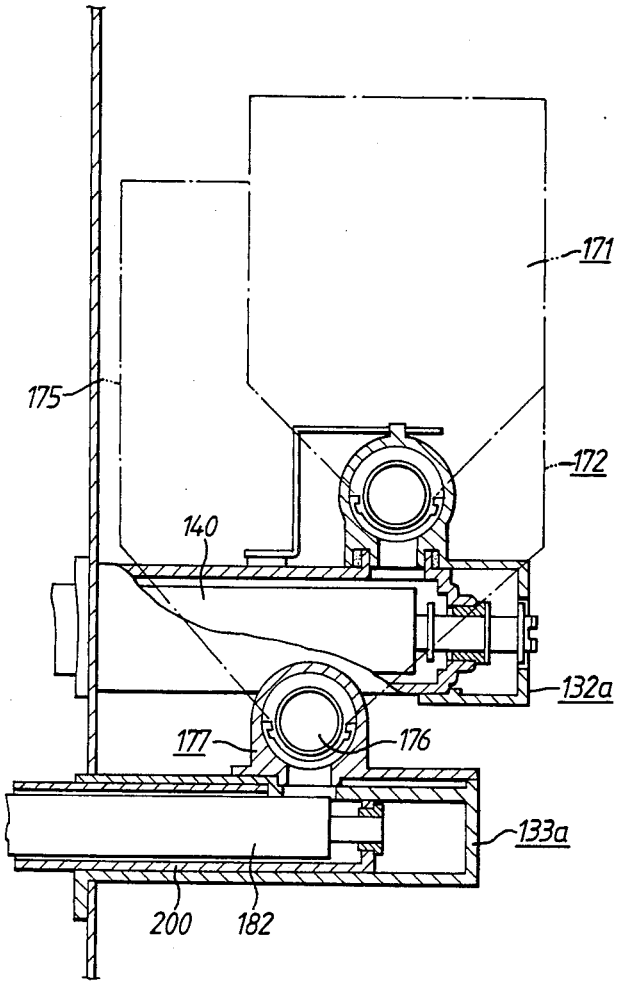
Figure 26A:
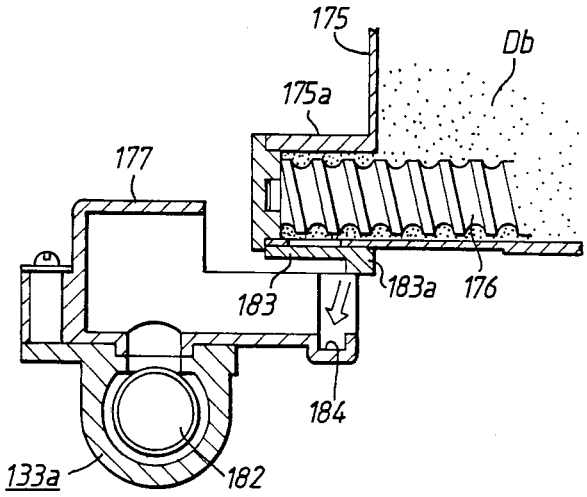
FIG. 26A is a sectional view illustrating the opening of a developer discharge port when a container of the supplementary developer supply unit is mounted.
Figure 26B:
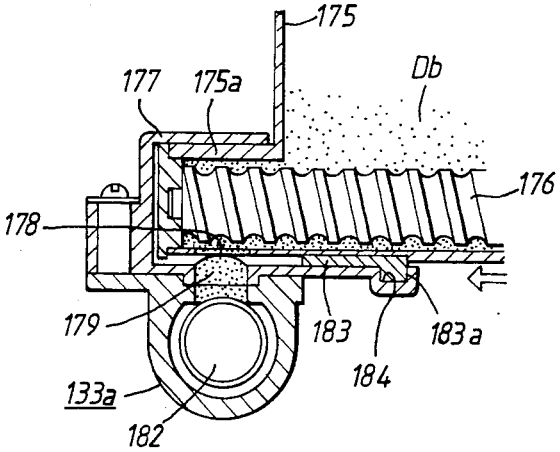
FIG. 26B is a sectional view illustrating the closing of a developer discharge port when a container of the supplementary developer supply unit is removed.

As shown in FIGS. 24 and 25, supplementary developer supply unit 171 for first development unit 132 has generally the same construction as supplementary developer supply unit 172 for second development unit 132. That is, 210 is a container which holds developer Da and in the bottom of which there is a feed screw 211 which feeds developer Da in the axial direction when it is rotatably driven. At the bottom of the side of container 210 towards which developer is moved by feed screw 211, a fitting projection 210a is defined which is detachably insertable into a holder 212 that is connected to developer reception and transport section 133a. The lower surface of holder 212 defines a developer discharge port 213 for discharge of developer Da that has been moved up by feed screw 122. Holder 212 is rotatably mounted on the upper-side surface of developer reception and transport section 133a and its lower surface defines a supplementary supply port 214 facing the space between developer mieers 140, which are in the form of spiral shafts. One end of feed screw 211 projects out of an end surface of holder 212 and has a coupling portion 211a which is coupled to a drive coupling 216 of a drive device 215. The underside of fitting projection 210a is fitted with a cover 217 that is slidable to open or close developer discharge port 213. A recess 218 is defined in holder 212 which engages a catch projection 217a formed on cover 217 and serves in the same way described above to slide cover 217 to open or close developer discharge port 213 when fitting projection 210a is inserted into or detached from holder 212. As shown in FIGS. 23 and 24, drive device 215 comprises a gear 219 integral with coupling 216, a worm gear 220 meshing with gear 219 and a motor 221 which drives worm gear 220 and is mounted on a movable base 222 that can slide in the directions of arrow G in FIG. 24. A support member 223 supports the side surface of container 210. Motor 221 is actuated for a set time, and feed screw 211 rotates, in response to a detection signal from developer run-out detector 173. As a result, developer Da in container 210 is fed to the developer discharge port 213 side and supplied into supplementary supply port 214 of developer reception and transport section 132a. Next, developer D that has been supplied into supplementary supply port 214 of developer reception and transport section 132a is uniformly distributed in developer receptacle 138 by developer mixers 140 and 140 in the form of spiral shafts.

To remove cartridge-type supplementary developer supply unit 171, when there is no more developer Da, etc., first, drive device 215, which is in the disposition shown in FIG. 24, is moved to the right so as to terminate the coupling action between coupling portion 211a of feed screw 211 and coupling 216. Next, supplementary developer supply unit 171 as a whole is swung forwards about holder 212 by pulling toward one. Mounting a new supplementary developer supply unit 171 is simply effected by following the reverse procedure.

Figure 28:
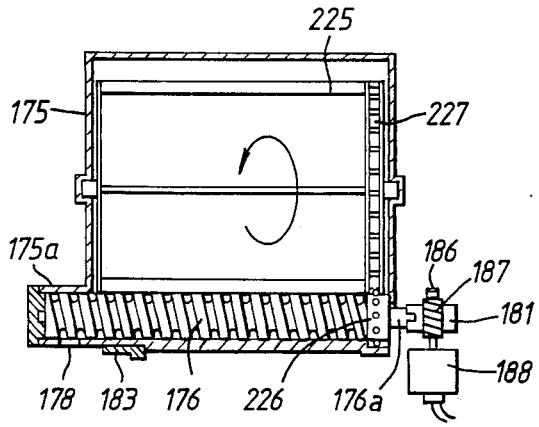
Figure 29:
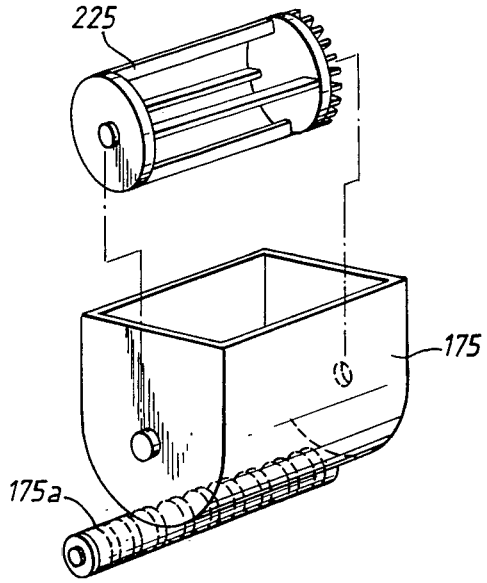

Referring to FIGS. 28 and 29, stirrer blades 225 are rotatably accommodated in the interior of container 175 containing developer Db. A plurality of teeth 227 engage a sprocket 22 mounted on feed screw 176 for moving developer Db towards the developer discharge port 18 side project from one end portion of stirrer blades 225. The rotation of feed screw 16 is accompanied by rotation of stirrer blades 225, thus giving a construction in which developer Db in container 15 is prevented from becoming lumpy or accumulating on one side and is supplied correctly without any being left behind.

Container 210 containing developer Da contains similar stirrer blades and is constructed so that developer Da in it is similarly stirred.

A recovery box 228 is provided for recovery of developer that is scraped off by cleaning unit 18 and is installed so that it can be easily removed when front cover 10 is opened. A magnet catch 229 attracts and holds cover 170.

Figure 30:
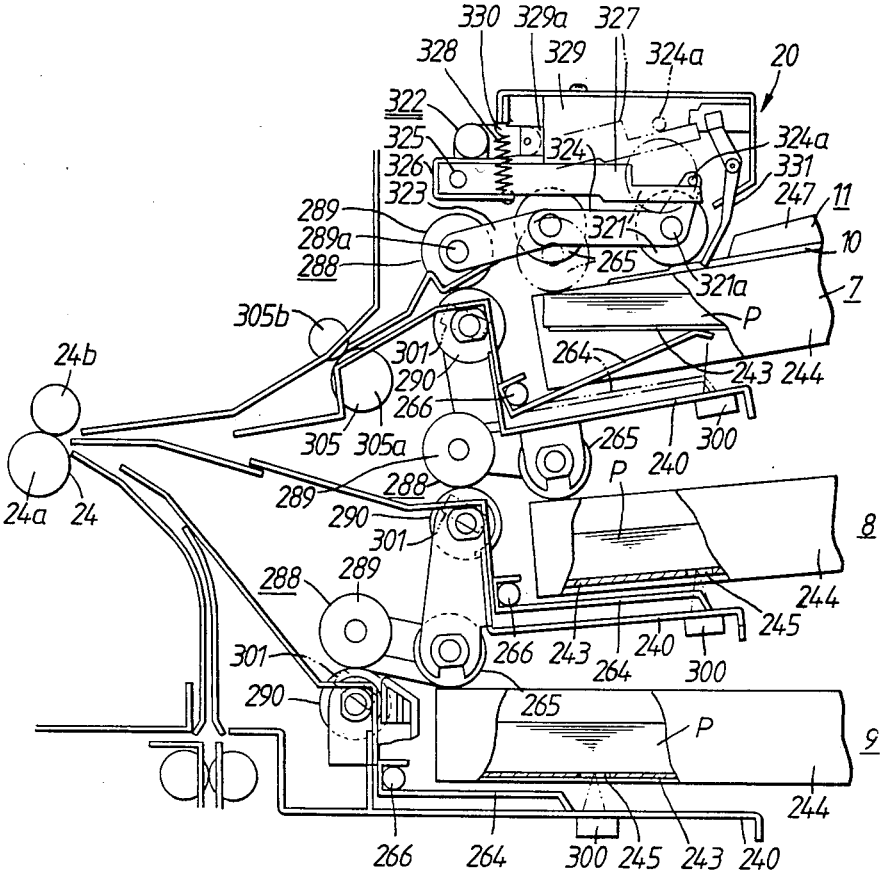
Figure 31:
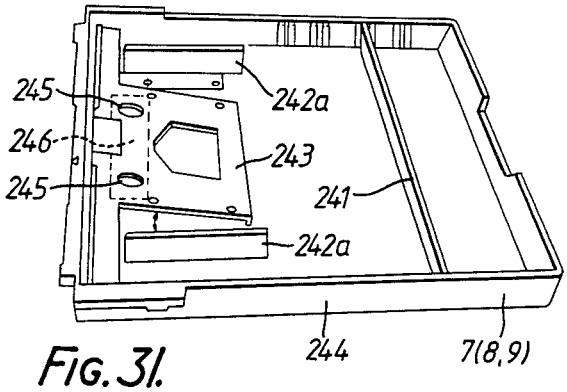
Figure 32:
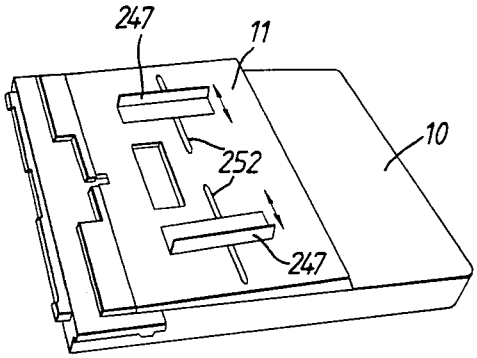
Figure 34:
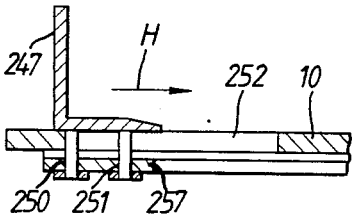
Figure 33:
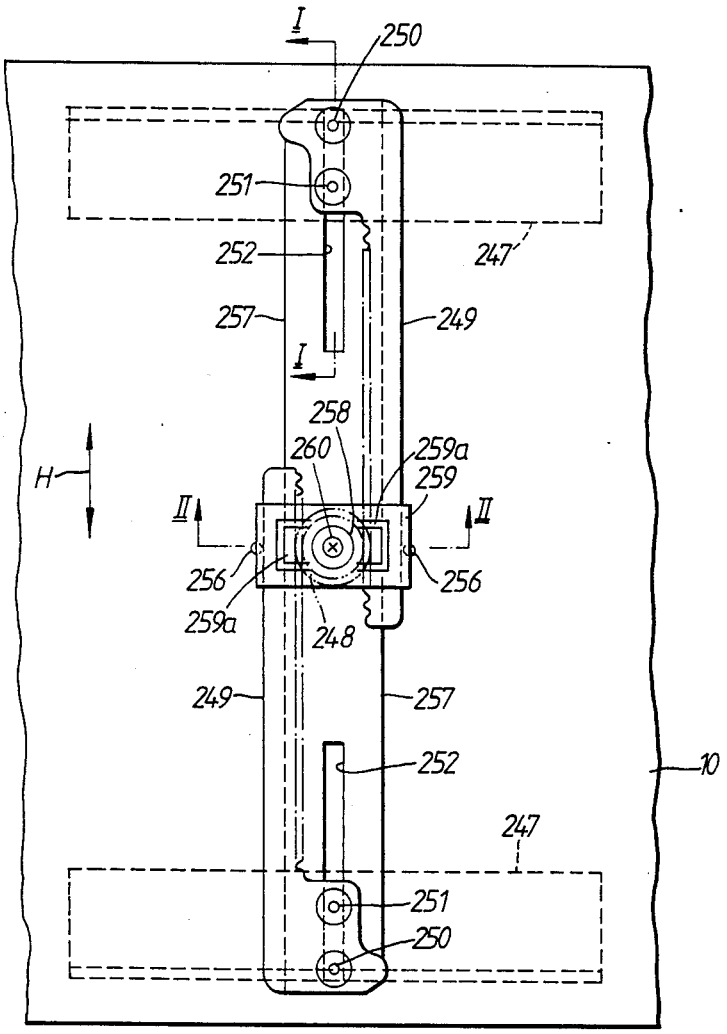

Next, the construction of automatic paper supply unit 20 will be described with reference to FIG. 30 through FIG. 34. As shown in FIG. 30, paper supply cassettes 7, 8 and 9 containing copy paper P are detachably mounted, via guides, above a base 240. Each paper supply cassette 7, 8 and 9 has a construction which, as shown in FIG. 31, comprises guides 241, 242*a* and 242*b* that determine the positions of the rear edge of copy paper P and of its two side edges and a copy paper support plate 243 that supports the take-out end of copy paper P. Copy paper support plate 243 is pivotally supported at one end which is engaged in a groove formed in the bottom surface of the cassette main body 244. Through-holes 245 and 245 are formed in copy paper support plate 243 and an opening portion 246 is defined in a position in the bottom portion of cassette main body 244 that corresponds to copy paper support plate 243. As shown in FIG. 32, the cassette cover 10 of the uppermost paper supply cassette 7 has a pair of guide members 247 and 247 on its upper surface which serves to guide the opposite side edges of copy paper P that is inserted manually. As shown in FIGS. 32–34, guide members 247 and 247 are mounted on cassette cover 10 and are so arranged that movement of one is accompanied by ganged movement of the other.

Figure 35:
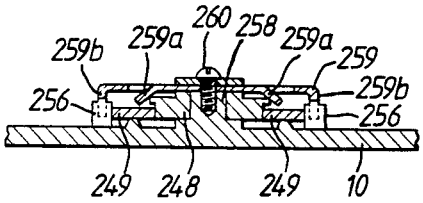

FIG. 33 shows cassette cover 10 of paper supply cassette 7 shown from the rear. A pair of racks 249 and 249 are disposed symmetrically about and each have one end meshing with a pinion 248 that is rotatably mounted in the central portion of cassette cover 10 going in the direction of its width. The other ends of racks 249 and 249 are fixed by pins 250 and 251 to guide members 247 and 247, which face one another. Thus, displacement of one guide member 247 in the direction of width H results in ganged slide movement of the other guide member 247 towards or away from it. In other words, pinion 248 and racks 249 constitute a ganging means that causes ganged movement of the tow guide members 247. Pins 250 and 251 are installed with a space between them and pass through corresponding long guide holes 252, as shown in FIG. 34, and thus guide racks 249 in movement in the direction of width H. Guide pins 256 that project from cassette cover 10 on opposite sides of pinion 248 are further provided and guide and retain respective racks 249, from their rear surfaces, and preventtthem coming out of engagement with pinion 248. A guide reinforcement plate 257 is mounted by suitable means on the rear surface of cassette cover 10 and disposed in a transverse direction parallel to the path of travel of racks 249. Guide reinforcement plate 257 also defines long holes matching long holes 252 in cassette cover 10. A support shaft 258 on which pinion 248 is rotatably supported projects from the rear surface of cassette cover 10, as shown in FIG. 35, and a braking element 259 including a rectangular plate spring is fixed on its upper end by a screw 260. A pair of tab pieces 259*a* and 259*a* cut out in left and right-hand side portions of braking element 259 are bent so that they are in flexible frictional engagement with the outer peripheral edge of pinion 248. Opposite edge portions 259*b* and 259*b* of braking element 259 are bent at right angles, and guide pins 256 and 256 are engaged in cutout portions (not shown) that are formed in these edge portions. Thus, rotary movement of pinion 248 subjected to a slight braking action by tab pieces 259*a* and 259*a*, and thus wild movement due to pinion 248 rotating too far, etc. is prevented. This means that movement of the ganging means as a whole is lightly braked, which action prevents mispositioning due to wide movement or vibration caused by inertia of moving elements when guide members 247 and 247 are moved.

Figure 36:
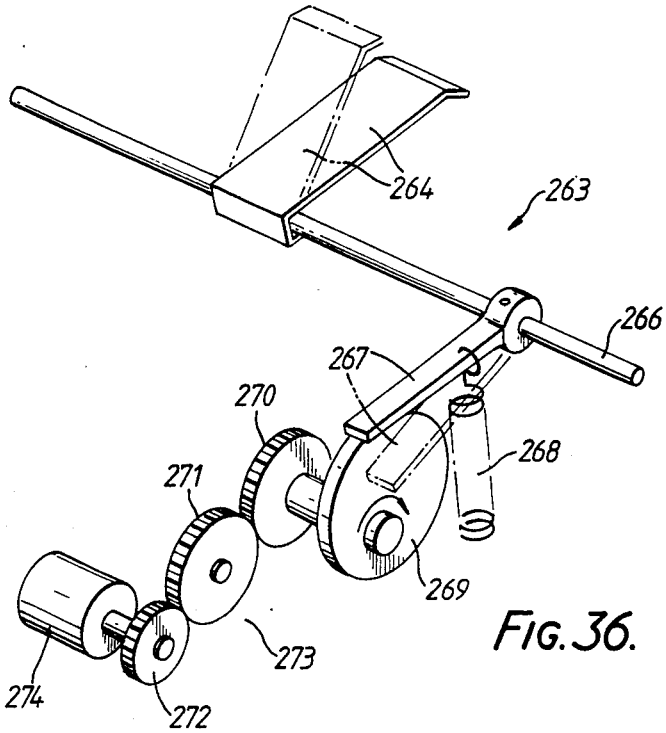

Each copy paper support plate 243 in paper supply cassettes 7, 8 and 9 can be selectively raised by rotation of a lifting lever 264 of a support plate lifting mechanism 263 provided in the section in which the respective cassette is mounted, whereby the topmost sheet of copy paper P is pressed with a suitable pressing force against a take-out roller (paper feed roller) 265. Support plate lifting mechanism 263 has a construction, shown in FIG. 36, in which 266 is a shaft that is rotatably supported by bearings and has mounted there on lifting lever 264 and an actuation lever 267 that are mutually offset by an angle of about 180°. A spring 268 is connected to actuation lever 267 and acts on it in a manner such that the lower surface of its free end is urged into constant contact with the peripheral surface of an eccentric cam 269 to which the drive force of a motor 274 is transmitted via a gear mechanism 273 consisting of successive meshing gears 270, 271 an 272. When motor 274 rotates and the largest eccentric portion of eccentric cam 274 is brought against actuation lever 267, actuation lever 267 is brought into a disposition in which it is raised up against the force imposed by spring 268 (this disposition show by full lines in FIG. 36), and when the smallest eccentric portion is brought against actuation lever 267, actuation lever 267 comes into a disposition in which it is pulled by spring 268 (this disposition shown by two-dot chain lines in FIG. 36). Since actuation lever 267 and lifting lever 266 are in an integral relation, this movement is accompanied by rotational displacement of lifting lever 264 to the dispositions indicated by full lines and two-dot chain lines in FIG. 36, thus causing copy paper P stacked on copy paper support plate 243 to move away from or to come into contact with take-out roller 265.

Figure 37:
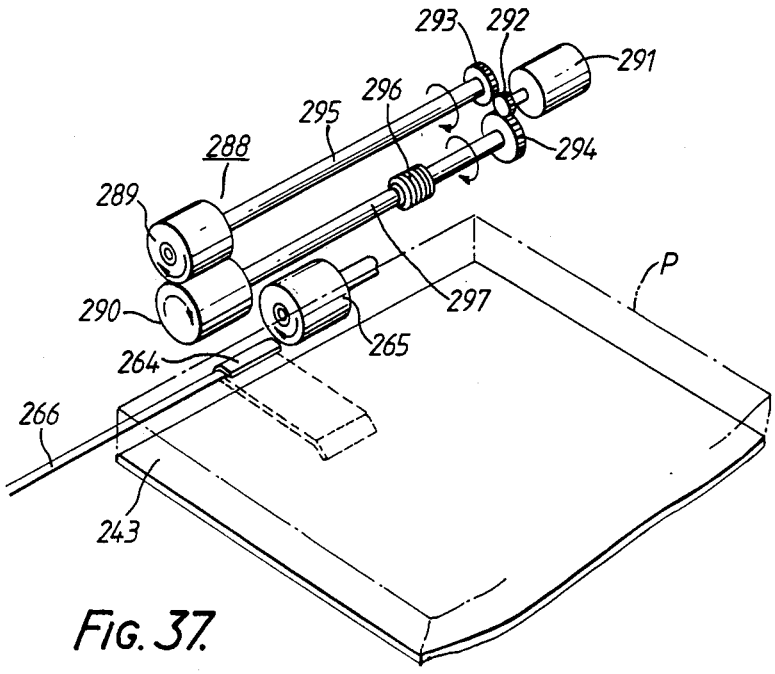
Figure 38A:
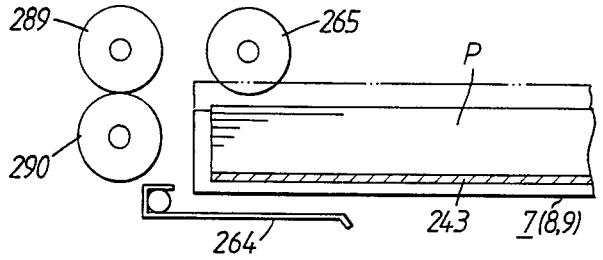
FIGS. 38A through 38D are schematic sectional views showing how the separation means separates copy paper.
Figure 38B:
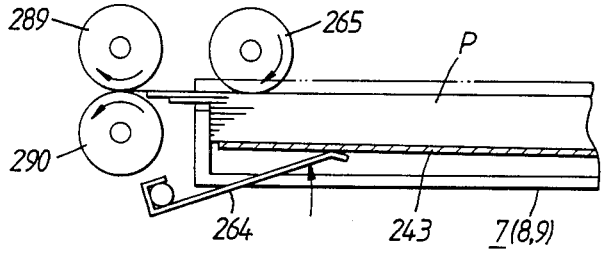
Figure 38C:
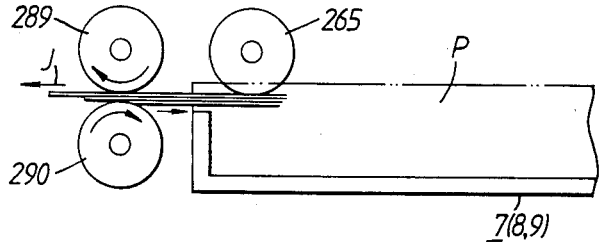
Figure 38D:
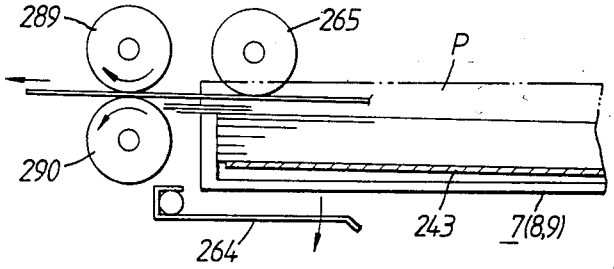

As shown in FIG. 30, in the line of copy paper take-out by take-out roller 265, mutually contacting rollers 289 and 290 are provided as a separation means 288 for effecting separation of and preventing take-out of second or subsequent sheets of copy paper P that have been taken stuck together. The construction for rollers 289 and 290 is shown in FIG. 37. A motor 291 is engaged with gears 293 and 294 via a gear 292. Gear 293 is connected to roller 289 by a shaft 295, while gear 294 is connected to roller 290 by a shaft 297 comprising a spring clutch 296 in an intermediate portion thereof. Spring clutch 296 is set so that it slips if the force of the roller 289 and 290 contact portions exceeds Ta, and, designating the force of friction between rollers 289 and 290 as Tb, the components set so that $Ta > Tb$, and so that roller 289 rotates in conformity with roller 290. Designating the force of friction between one sheet of copy paper P and another as Tf and the force of friction between roller 265 and a sheet of copy paper P as Tr, generally $Tr > Tf$ since roller 265 is made of rubber or similar material with a high coefficient of friction. Further, Ta is set so that $Tr > Ta > Tf$. The state during paper supply standby is one in which copy paper P is out of contact with take-out roller 265, as shown in FIG. 38A. At the time of paper supply, copy paper P is brought into contact with take-out roller 265 by the lifting action of lifting lever 264 as shown in FIG. 38B. Then, as take-out roller 265 rotates, the topmost sheet of copy paper P is fed to between rollers 289 and 290 constituting separation means 288. If, when this happens, the second sheet or the second and subsequent sheets of copy paper P are taken out because they are drawn into contact with the topmost sheet of copy paper P, they are separated as the result of a reverse rotation action of roller 290, as illustrated in FIG. 38C, and only the topmost sheet of copy paper P is taken out. This happens because on entry of copy paper P between rollers 289 and 290, roller 289 moves copy paper P in the direction of arrow J, ecause Tr>Tf, but roller 290 returns copy paper P in the opposite direction, because Tr>Ta>Tf. Once take-out of one sheet commences, lifting lever 264 goes down as shown in FIG. 38D to return to standby as in the state shown in FIG. 38A.

Figure 39A:
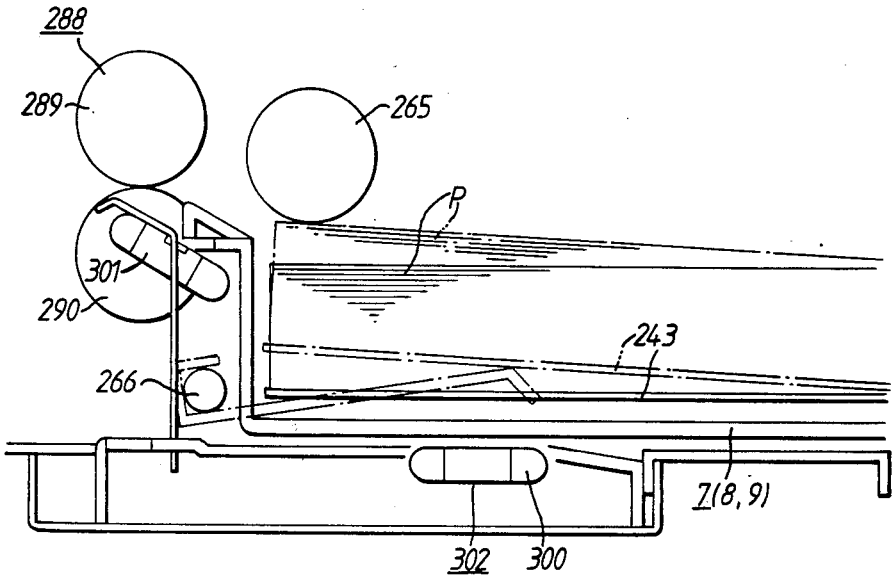
FIGS. 39A and 39B are schematic sectional views showing the disposition of copy paper detectors of a paper supply cassette mounting section.
Figure 39B:
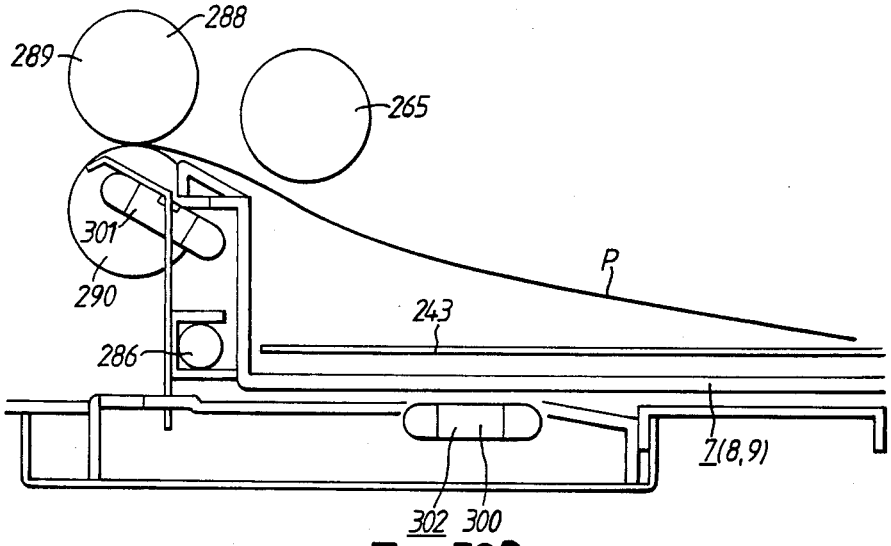

As shown in FIG. 39, reflection-type optical sensors 300 and 301 that serve as copy paper detectors and are each connected to a control section are provided in a position facing the bottom surface of paper supply cassette 7, 8 or 9 and in a position facing the copy paper transport path immediately prior to separation means 288. A paper run-out detection means 302 is also provided which takes the sum of "No copy paper" detection signals from both sensors 300 and 301 to indicate that copy paper has run out. If copy paper P is loaded on copy paper support plate 243 as shown in FIG. 39A, it can be detected when copy paper support plate 243 is lowered. In the state where a last sheet that has been separated by roller 290 is gripped by rollers 289 and 290, as shown in FIG. 39B, sensor 300 in a position facing the bottom of paper supply cassette 7 (8, 9) cannot detect it but it can be detected by sensor 301 in a position facing the copy paper transport path immediately prior to separation means 288. It is thus possible to prevent a determination that the copy paper has run out despite the fact that there is copy paper P there. Use of reflection-type optical sensors as opy paper detectors offers the advantage that copy paper P can be detected without being touched and that the detectors are easy to mount. Further, light is less likely to have an effect than in cases where transmission-type optical sensors are used.

Figure 40:
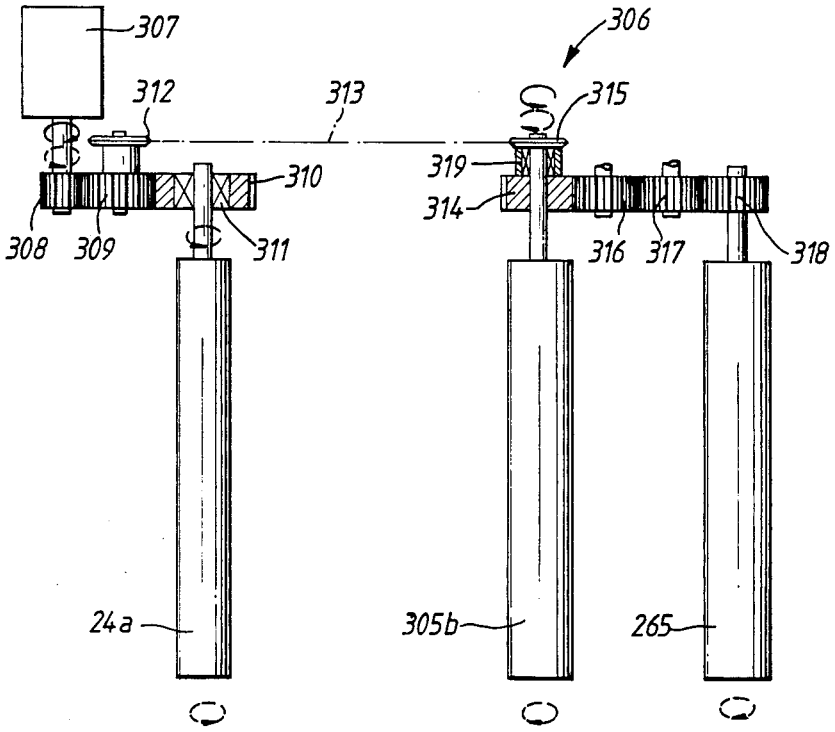

As shown in FIG. 30, after it has passed through separation means 288, copy paper P comes against the contact portion of rollers 24*a* and 24*b* that constitute registration rollers 24 and are currently stationary. After the inclination (skew) of copy paper P's leading edge has been corrected, it is fed into image transfer section 21 in synchrony with an operation for formation of an image on photosensitive drum 12. Between separation means 288 in the uppermost section and registration rollers 24, forwarding rollers 305 are provided consisting of a roller 305 and a roller 306. Take-out rollers 265, roller 305*b* of forwarding rollers 305 and rollers 24*a* of registration rollers 24 are driven by the drive system 306 shown in FIG. 40. More particularly, a drive gear 308 mounted on the drive shaft of a stepping motor 307 engages a gear 310 via an intermediate gear 309. Gear 310 is mounted via a one-way clutch 311 on the shaft of one of the rollers, roller 24*a*, of registration rollers 24. A sprocket 312 is mounted integrally on intermediate gear 309 and is connected by a chain 313 to a sprocket 315 integral with a follower gear 14. Sprocket 315 is mouneed via a one-way clutch 319 on the shaft of roller 305*b* and gear 314 is mounted on the shaft of roller 306*b*. Follower gear 314 is also engaged successively via intermediate gears 316 and 317 to a gear 318 mounted on the shaft of take-out roller 265.

When motor 307 rotates forwardly (the direction of the full-line arrow), one-way clutch 311 is disengaged and one-way clutch 315 is engaged, and so take-out roller 265 and roller 305*b* are driven. Roller 24*a* remains stationary since no drive power is transmitted to it. When motor 307 rotates in reverse (in the direction of the dashed-line arrow), one-way clutch 311 is engaged and one-way clutch 315 is disengaged and so only roleer 24*a* is driven. Rollers 305*b* and 265 remain stationary since no drive power is transmitted to them by the action of one-way clutch 319. Thus, the arrangement is one in which take-out roller 265 and roller 24*a* are selectively rotated by forward and reverse rotation of pulse motor 307.

Figure 41:
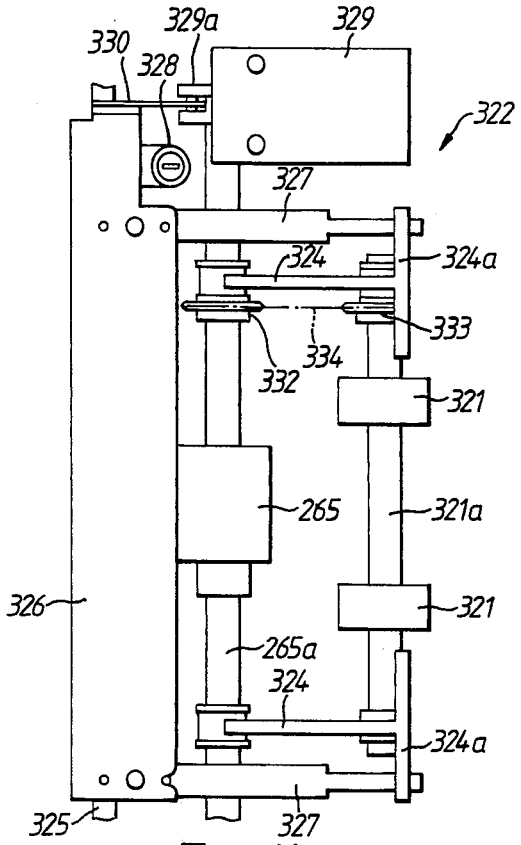

Manual insertion rollers 321 are provided in the uppermost paper supply cassette section by which sheets of copy paper Psset in a stack on manually inserted paper supply block 11 are taken out one at a time and forwarded via the take-out roller 265 section to the separation means. Manual insertion rollers 321 and take-out roller 265 are constructed so that they can be moved into or away from the copy paper transport path by the contact-disengagement means 322 shown in FIG. 30 and FIG. 41. The arrangement is such that take-out roller 265 is moved away from the cppy paper transport path at least during supply of manually inserted paper. The support shaft 265*a* of take-out roller 265 is mounted on and supported by the free ends of arms 323 and 323. Arms 323 are pivotal about support shaft 289*a* of roller 289 in separation means 288. Manual insertion roller 321 are mounted and supported at the free end portions of arms 324 and 324 which are in turn pivotal about take-out roller 265 support shaft 256*a*. The free end portions of arms 324 and 324 are provided with retainer projection portions 324*a* and 324*a* that are disposed normally to them. Arms 324 extend to above the free ends of levers 327 and 327 mounted on a swing member 326 which is supported in a manner permitting it to pivot freely about a support shaft 325. The normal state of swing member 326 is one in which it is urged in an counterclockwise direction a seen FIG. 30 by a spring 328 to a disposition in which the retainer projection portions 324*a* and 324*a* of arms 324 and 324 holding the support shaft 321*a* of manual insertion rollers 321 are in a raised attitude. The plunger 329*a* of a plunger-type solenoid 329 is connected via a coupling element 330 to swing member 326. Thus swing member 326 can be rotated counter to the force of spring 328. A manually inserted paper supply switch 331 is provided in front of manual insertion rollers 321 (as shown in FIG. 30). As shown in FIG. 41, a sprocket 332 is mounted on take-out roller 265 support shaft 265*a*, a sprocket 333 is mounted on support shaft 321*a* of manual insertion rollers 321 and these sprockets are connected by chain 334.

Manually inserted paper supply switch 331 is switched on when copy paper P is set on manually inserted paper supply block 11, and solenoid 329 is energized when copy key 30 is actuated. Swing member 326 is then rotated and moved counter to the force of spring 328 and manual insertion roller 321 is lowered. This movement is accompanied by upward displacement of take-out roller 265 away from the copy paper transport path. Then, when copy paper P is forwarded to separation means 288, solenoid 329 is de-energized, and roller 265 goes to its lowered position. Liftng lever 264 for pushing up copy paper support plate 243 of paper supply cassette 7 is lowered at this time, and so the copy paper P is out of contact with take-out roller 265.

Figure 42A:
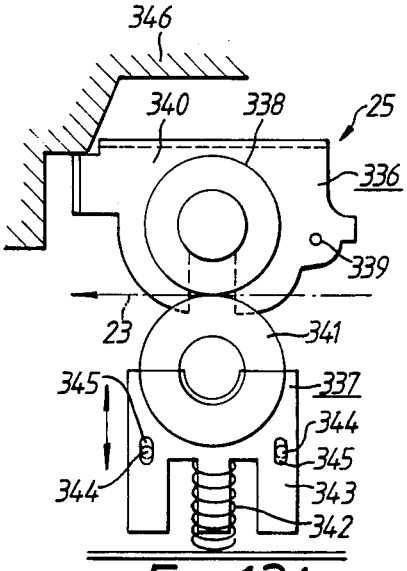
FIGS. 42A and 42B are schematic front views showing the construction of a fixing unit.
Figure 42B:
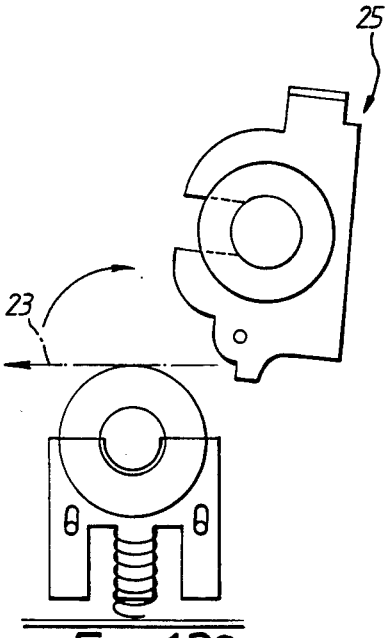

Fixing unit 25 will now be described with reference to FIG. 42. Fixing unit 25 can be broadly divided into an upper roller unit 336 and a lower roller unit 337. Upper roller unit 336 has a construction in which a heat roller 338 that has a teflon coating on its outer surface and a heat source (not shown) inside is mounted in a bracket 340 that is rotatably supported by a support shaft 339. Lower roller unit 337 has a construction in which a pressure roller 341 constituted by a rubber roller is mounted in a bracket 343 that is constantly urged upwards by a compression spring 342. Bracket 343 has elliptical holes 345 and 345 through which guide shafts 344 and 344 pass and can move upwards or downwards over the range of elliptical holes 345 and 345. Adjacent the free end of bracket 340 of upper roller unit 336, a movable frame 346 is provided which constitues a portion of the frame of the upper unit, which is installed so that it can be rotatably displaced. Copy paper transport path 23 in housing 4 is the approximate boundary of this displacement, so as to move it away from the lower unit. As shown in FIG. 42A, in the state in which the upper unit is overlaid on the lower unit, movable frame 346 contacts an upper surface portion of the free-end side of bracket 340 and heat roller 338 is swung over into contact with pressure roller 341, which it presses down counter to the force of compression spring 342, so as to give a set contact pressure. In the state in which the upper unit has been moved away from the lower unit in order to lay open copy paper transport path 23, when this is necessary because of paper blockage or for inspection, etc., movable frame 346 is spaced from the upper surface portion of the free-end side of bracket 340, and bracket 340 can be rotated to a maximum of about 95 about support shaft 339, as shown in FIG. 42A. This construction makes it easy to effect replacement of heat roller 338 and pressure roller 341.

Figure 43:
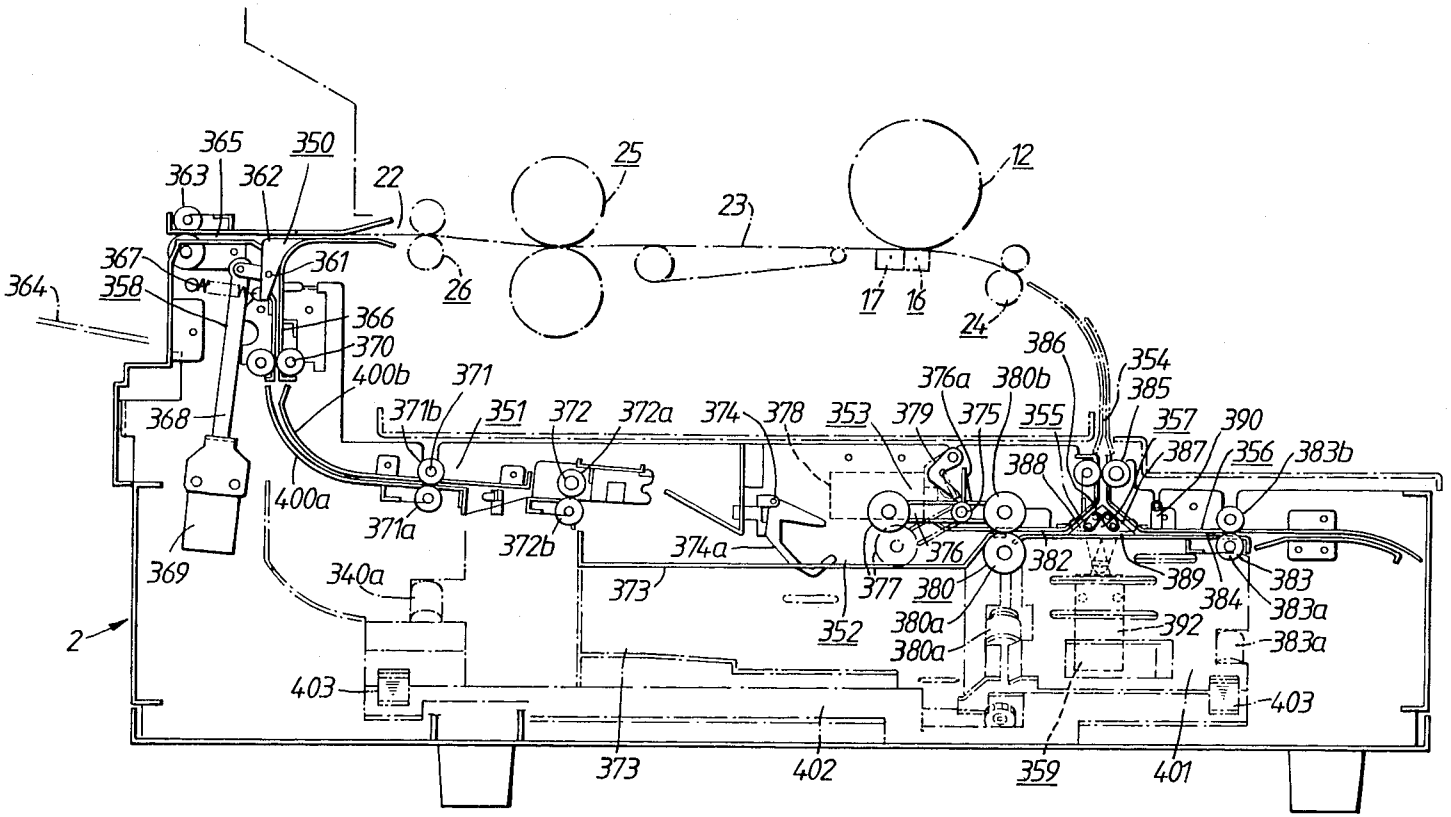

A direction-change transport unit 2 by which, depending on requirements, copy paper P fed out from feed-out section 22 can be received and can be returned again to the image formation section of copying machine main body 1, either as it is or after it has been turned upside down, will now be described with reference to FIGS. 43 through 47. As shown in FIG. 43, direction-change transport unit 2 is a unit that is independent of copying machine main body 1 and it also serves as a stand on which copying machine main body 1 can be detachably placed. Direction-change transport unit 2 includes a guide means 350 which is provided at the side of feed-out section 22 an which, depending on requirements, can effect lead-in of copy paper P that has been fed out. A carry-in path 351 is further provided for carrying in copy paper P that has been guided in by guide means 350. Unit 2 further includes temporary stacking section 352 in which copy paper P carried in along carry-in path 351 is temporarily stacked and a take-out means 353 by which sheets of copy paper P stacked in temporary stacking section 352 are taken out in succession, one sheet at a time. A first transport section 355 leads copy paper P again into a copy paper lead-in section 354 of copying machine main body 1 without the direction of its leading edge being changed, in order to permit multiple image formation, and a second transport section 356 is provided as a branch-off from first transport section 355. Second section 356 changes the transport direction of copy paper P that has been taken by take-off means 353, making its rear edge its leading edge, so as to permit formation of images on both sides, and then leads the copy paper P to copy paper lead-in section 354 of copying machine main body 1. A directing means 357 is provided in the section where second transport section 356 branches off from first transport section 355 and effects selective direction of copy paper P that has been taken by take-off means 353. Drive eeans 358 and 359 effect switching of guide means 350 and directing means 357, etc. in response to changeover signals, etc. resulting from actuation of mode setting key 43, etc.

Guide means 350 consists of a gate 363 which is rotatably provided on a support shaft 361. Gate 363 is located in a branched section between a straight-line transport path 366, which leads to a delivery tray 365 via copy paper feed-out section 22 of copying machine main body 1 and feed-out rollers 363, and a transport path 366 leading to temporary stacking section 352. Gate 363 selectively guides copy paper P as a result of being actuated by drive means 358. More particularly, gate 362 is constantly urged in a set direction by a spring 367 so that transport path 366 is normally closed and straight-line transport path 365 is open. Gate 362 is also connected to a solenoid 369 via a connection member 378, giving a construction whereby gate 362 can be swung counter to the force of spring 367 to open transport path 366 and close straight-line transport path 365 if required. Transport path 366 has first forwarding rollers 370, second forwarding rollers 371 and third forwarding rollers 372 provided on it to forcibly transport copy paper P into temporary stacking section 352. As described below, third forwarding rollers 352 have a construction in which the copy paper P reception and carry-out position is movable with respect to the line of copy paper P feed, whereby, whatever the copy paper P size, the leading edge of copy paper P can come in correspondence with a take-out means 353 that is provided in correspondence to the take-out end of temporary stacking section 352.

Temporary stacking section 352 is defined by the upper surface portion of guide plate 373, and the actuator **374*a* of a copy paper detection means 374** is provide facing its central portion.

Take-out means 353 consists of a take-out roller 377 which is held on the free-end portion of an arm 376 which is pivotal on a support shaft 375 and which is displaced to an upper position when copy paper P is stacked in temporary stacking section 352 so as not to hinder stacking of copy paper P. More particularly, the pivot end of arm 376 has a projection portion **371*a* which contacts a lever 378 that is rotated by a solenoid 378 serving as a drive source. Energization of solenoid 378 results in projecting portion 376*a* causing take-out roller 377 to be displaced upwards as indicated by full lines in FIG. 43. When solenoid 378 is de-energized, take-out roller 377 falls downwards under its own weight as indicated by two-dot chain lines in FIG. 43 and thus swings into contact with copy paper P stacked in temporary stacking section 352. In the line of copy paper take-out by take-out means 353 thus constructed, there are forwarding rollers 380 consisting of rollers 380*a* and 380*b*, so that copy paper P which has been taken out of temporary stacking section 352 can be forwarded to directing means 357**.

Figure 44:
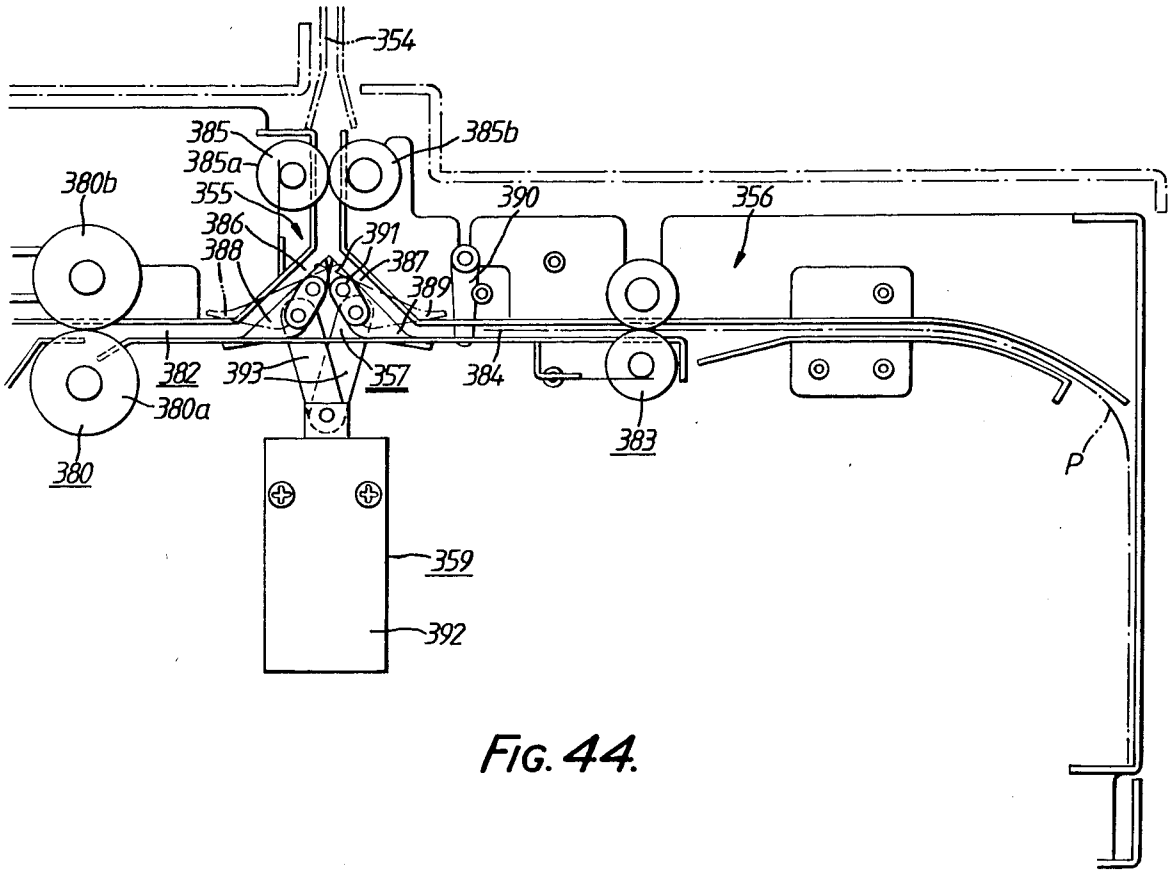

Next, the structure of the section for changing the direction of copy paper P that has been taken from temporary stacking section 352 and brought up via forwarding rollers 380 will be described with reference to FIG. 44. The section consists of a first transport path 382 on which forwarding rollers 380 are provided and over which copy paper P is carried, a second transport path 384 which is provided as a communicating continuation of first transport path 382 and is provided with forwarding rollers 383, a third transport path 386 which branches from an end portion of first transport path and is provided with forwarding rollers 385 and a fourth transport path 387 which branches from the starting end portion of second transport path 384 and merges with third transport path 386. Directing means 357 is constituted by the provision of a first guide means 388, which is provided at the location of the branch between first transport path 382 and third transport path 386 and by which copy paper P that has been moved up along first transport path 382 by forwarding rollers 380 is selectively led to second transport path 384 or third transport path 386. A second guide means 389 is provided at the location of the branch between second transport path 384 and fourth transport path 387 so that copy paper P fed back along second transport path by forwarding rollers 383 is guided to the fourth transport path 387 side. Second transport path 384 is also provided with a copy paper detection means 390 which detects when the rear edge of copy paper that has been led into second transport path 384 from first transport path 382 reaches a set position and effects control to cause forwarding rollers 383 to effect reverse transport of the copy paper P. The structure is one in which, through switching of first and second guides 388 and 389, copy paper P that has been fed along via first transport path 382 is forwarded with its leading edge in the line of transport remaining unchanged or is forwarded after a change in direction of transport such that what was its rear edge in the line of transport becomes its leading edge and then is again fed into copy paper lead-in section 354 of copying machiee main body 1. first and second guide means 388 and 389 are guide members that are pivotally supported by support shafts 391 and are connected by connection members 393 and 393 to the plunger 392*a* of a plunger-type solenoid 392, and are rotatably displaced in the manner indicated by full lines and two-dot chain lines in FIG. 44 by energization and de-energization of solenoid 392.

Operation for single original document, both-side copying, will now be described as an example.

(a) First, mode setting key 43 on control panel 6 is actuated to set the "single original document, both-side copying mode", the number of copies, amount of exposure light (copy density) and copy magnification, etc. are set by other operations, and then copy key 30 is depressed.

(b) Solenoid 369 of guide means 350 is withdrawn and copy paper P on which a copy has been produced is led into direction-change transport unit 2.

(c) Copy paper P which has had a copy produced on one side is stacked in temporary stacking section 352.

(d) Solenoid 396 of guide means 350 returns.

(e) The original document is rearranged and copy key 30 is depressed again.

(f) Solenoid 378 of take-out means 353 provided in temporary stacking section 352 is withdrawn and take-out roller 377 is lowered.

(g) Take-out roller 377, forwarding rollers 380 that also serve as separating means and forwarding rollers (switch-back roller pair) 383 rotate.

(h) After sufficient time for the leading edge of a sheet of copy paper P to reach forwarding rollers 380, take-out roller solenoid 378 returns and take-out roller 377 rises.

(i) After sufficient time for the leading edge of the copyppaper P to reach forwarding rollers 387, forwarding rollers 380 stop. However, forwarding rollers 380 are fitted with a one-way clutch and the copy paper P, which is pulled by forwarding rollers 383, rotates them until the rear edge of the copy paper P is clear of them.

(j) Once the rear edge of the copy paper P has passed copy paper detection means 390, forwarding rollers 383 are rotated in reverse, solenoid 392 of directing means 357 is withdrawn and forwarding rollers (forwarding roller pair) 385 rotate.

(k) When the leading edge of the copy paper P reaches registration rollers 24 located just in front of image transfer section 21 in copying machine main body 1, forwarding rollers 383 and 385 stop and registration of the copy paper P is effected.

(l) The copy paper P is fed into image transfer section 21 and once its rear edge is well clear of directing means 357, solenoid 392 of directing means 357 returns. However, forwarding rollers 385 are fitted with a one-way clutch and are rotated by the copy paper P, which is pulled by registration rollers 24.

(m) With direction means 357 in the returned state, the actions (f)–(l) above are repeated until temporary stacking section 352 contains no more copy paper P with a completed copy on one side.

Next, a double copying will be described, for example.

(a) First, mode setting key 43 on control panel 6 is actuated to set the "double copying mode", the number of copies, amount of exposure light (copy density) and copy magnification, etc. are set by other operations, and then copy key 30 is depressed.

(b) Solenoid 369 of guide means 350 is withdrawn and copy paper P on which a copy has been produced is led into direction-change transport unit 2.

(c) Copy paper P which has had a copy produced on one side is stacked in temporary stacking section 352.

(d) Solenoid 396 of guide means 350 returns.

(e) The original document is replaced and copy key 30 is depressed again.

(f) Solenoid 378 of take-out means 353 provide in temporary stacking section 352 is withdrawn and take-out roller 377 is lowered.

(g) Solenoid 392 of directing means 357 is withdrawn and take-out roller 377, forwarding rollers 380 that also serve as a separating means and forwarding rollers (forwarding roller pair) 385 rotate.

(h) After sufficient time for the leading edge of a sheet of copy paper P to reach forwarding rollers 380, take-out roller solenoid 378 returns and take-out roller 377 rises.

(i) After sufficient time for the leading edge of the copy paper P to reach forwarding rollers 385, forwarding rollers 380 stop. However, forwarding rollers 380 are fitted with a one-way clutch and the copy paper P, which is pulled by forwarding rollers 385, rotates them until the rear edge of the copy paper P is clear of them.

(j) Once the copy paper P reaches registration roller 24 located just before image transfer section in copying machine main body 1, forwarding rollers 385 stop and, after registration of the copy paper P, the sheet of copy paper P is forwarded to image transfer section 21.

(k) With guide means 350 remaining in the returned state, the actions (f)–(j) above are repeated until temporary stacking section 352 contains no more copy paper P with a completed copy on one side.

Direction-change transport unit 2 is thus formd such that, depending on requirements, copy paper P delivered from copy paper feed-out section 22 of copying machine main body 1 can be received and can be led again to image transfer section 21, either as it is or after it has been turned upside down, so as to permit multiple or both-side image formation on it. In addition, unit 2 has a construction such that elements on one side (the lower side) of a boundary constituted by the copy paper transit path can be displaced outwards (downwards) so as to open up the copy paper transit path, as indicated by the two-dot chain line portion of FIG. 43. More particularly, the lower guide board 400*a* of guide boards 400*a* and 400*b* that define a portion of transport path 366, th lower roller 371*a* of forwarding rollers 371, guide plate 373 constituting temporary stacking section 352, a lower guide board 401 defining first and second transport paths 382 and 383, lower roller 380*a* of forwarding rollers 380 and lower roller 383*a* of forwarding rollers 383 are mounted in a support frame 402 which is installed so that it is pivotal about one side of the line of copy paper P transport. Thus, displacement action of support frame 402 is accompanied by outward displacement of all the elements together to open up the copy paper transit path. The free-end side of support frame 402 is fitted with holder means 403 and 403 which hold it in a set attitude. Manipulation of holder means 403 and 403 permits the copy paper transport section to be opened, making it easy to deal with paper jams, etc.

Figure 45:
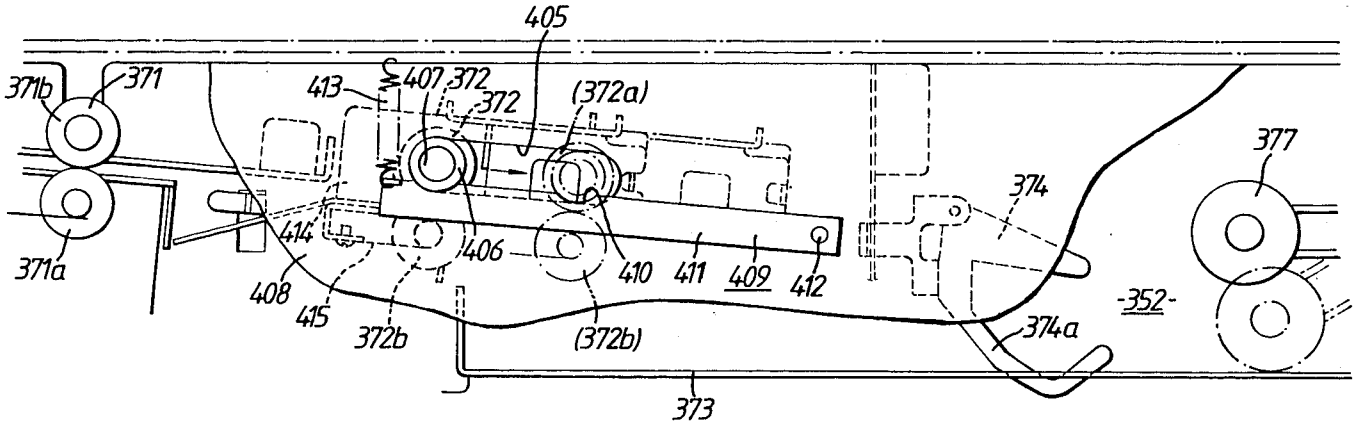
Figure 46:
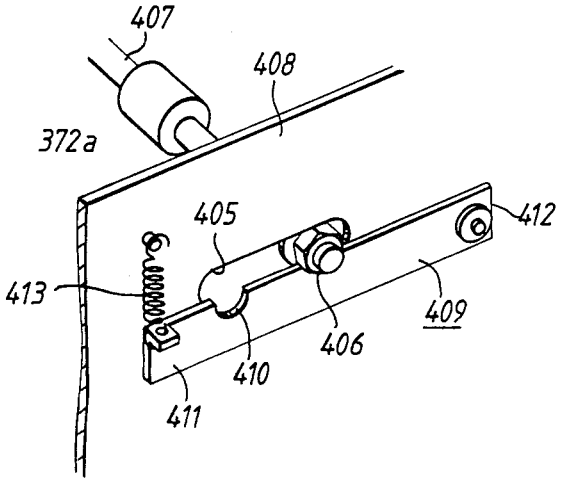
Figure 47:
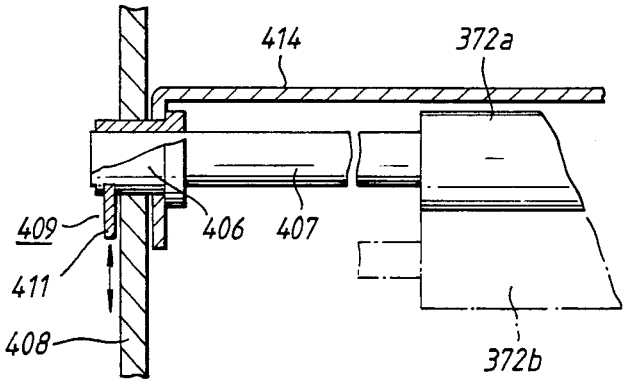

As shown in FIGS. 45 through 47, the carry-in means by which successively forwarded sheets of copy paper P are received and fed in to be stacked in to be stacked in temporary stacking section 352 is movable with respect to the line of copy paper P feed-in. As can be seen, the carry-in means consists of forwarding rollers 372, including a drive roller 772*a* as a first forwarding roller and a follower roller 372*b* as a second forwarding roller. Drive roller 372 has a support shaft 407 that is mounted so that it is movable by bearings (bushes) 406 and 406 supported in slits 405 and 405 constituting guide sections. Follower roller 372*b* is mounted so that it is always in rolling contact with drive roller 372*a*, to permit copy paper P to be gripped and forwarded between itself and drive roller 372*a* and is arranged so that it is movable integrally with drive roller 372*a*. Slits 405 and 405, respectively formed in side frames 408 and 408 that are separated and face one another on opposite sides of the copy paper transport path. Bearings 406 and 406 that are supported in slits 405 and 405 can be fixed in set positions in accordance with copy paper P size by positioning means 409 and 409 which are provided on the outsides of frames 408 and 408. As shown in FIGS. 46 and 47, positioning means 409 are disposed parallel to the displacement paths of bearing 406 and 406 and have a construction comprising levers 411 that constitute positioning members with a plurality of recess portions 410 and 410 into which a portion of a bearing 406 can fit. Each lever 411 has one end pivotally mounted on a frame 408 by a shaft 412, while its other end is connected to a spring 413 which constantly urges a bearing 406 into engagement with a recess portion 410.

Referring to FIGS. 45 and 47, a movable frame 414 holds bearings 406 and can move integrally with drive roller 372*a*. A plate spring 415 is mounted on movable frame 414 and urges follower roller 372*b* towards drive roller 372*a*.

To set forwarding rollers 407 and feed copy paper P into temporary stacking section 352 in a position matching the copy paper P size, movable frame 414 is simply moved when both levers 411 have been rotated counter to the force of springs 413 and bring bearings 406 and 406 into set recess portions 410. Thus, forwarding rollers 407 can be moved to a position matching the copy paper P size very easily, without use of a tool such as a screwdriver, etc., and copy paper P can be stacked in good order in temporary stacking section 352 in a state permitting it to be taken out.

Figure 2:
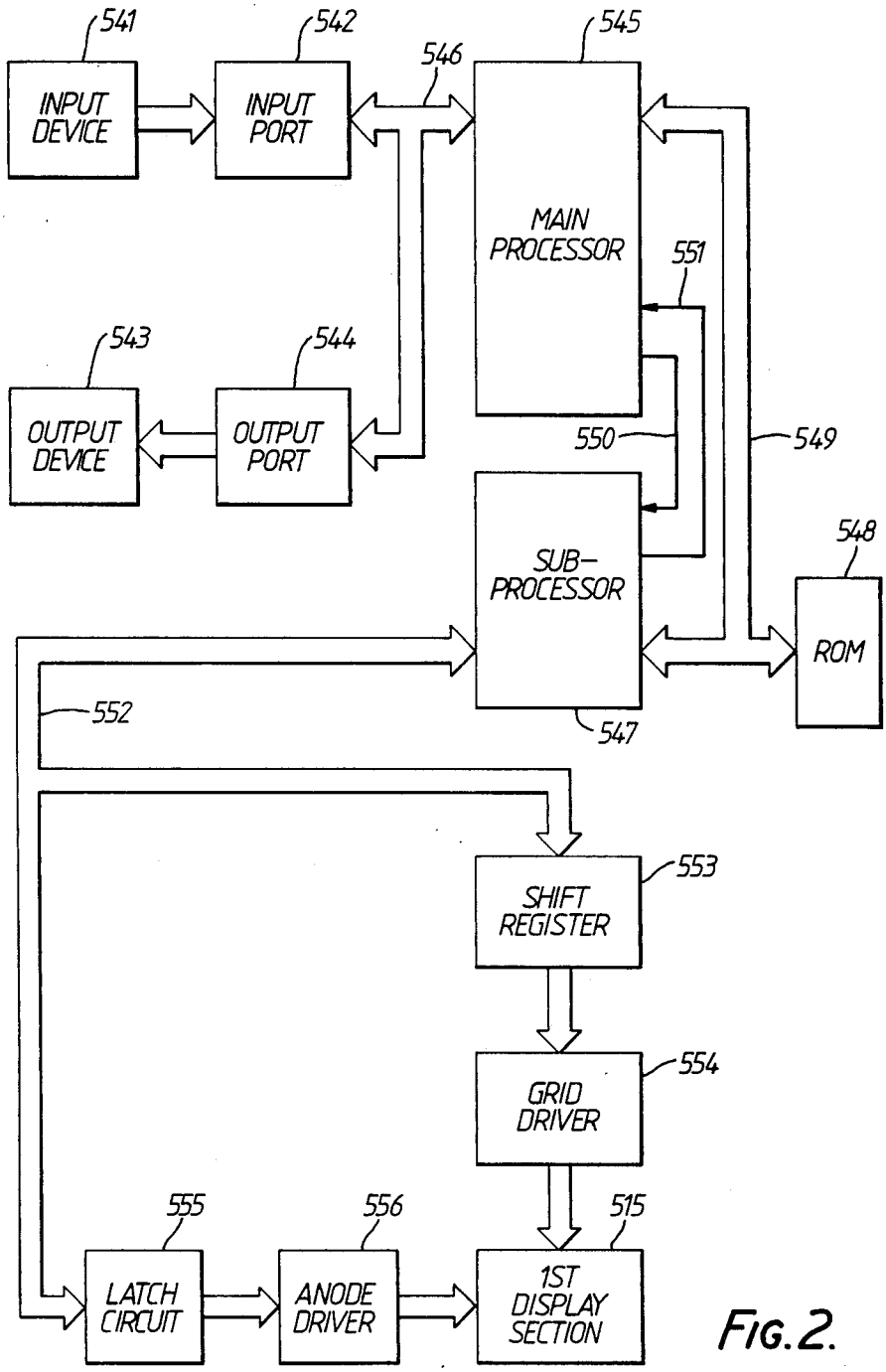

FIG. 2 shows a control circuit. An input device 541 is provided for detecting statuses in the copying machine, e.g., of various sensors, switches or key switches on the control panel, etc. and has an input port 542. An output device 543 is provided for the exposure lamp, the fixing unit's heater, the high voltage sources of the various chargers and various motors, etc. and has an output port 544. A main processor 545 effects overall control of the copying machine and is connected to input port 542 and output port 546 by a data bus 546. A subprocessor 547 is responsible for textual displays. More particularly, a ROM (Read-Only Memory) 548 stores execution subprograms together with character patterns and text data and is connected to subprocessor 547 by a data bus 549. Texts that are to be displayed are supplied in code from main processor 545 to subprocessor 547 via data bus 549 and subprocessor 547 displays a text in accordance with this input. When a text code is to be sent, main processor 545 uses an interrupt signal 550 to notify subprocessor 547 that it is about to send data. On receipt of this, subprocessor 547 informs main processor 545 by means of a response signal 551 that it is able to receive data and reads in data that has been set in data bus 549.

First display section uses fluorescent display tubes for, e.g., 40 places one place being constituted by 5×7, or a total of 35 dots. The fluorescent display tubes are electronic triodes in which a cathode, grid and anode are sealed in a high vacuum glass container and thermoelectrons emitted from the cathode are accelerated by positive voltages imposed on the grid and anode and excite and cause emission of light by a phosphor coated on the anode, it is thus possible to display required numeral, letters or symbols by selective imposition of voltage on anodes and grids. On the grid side, a shift register 533 is provided that is connected to subprocessor 547 by a data bus 552, and a grid driver 554 scans successive grids, one place at a time. On the anode side, a latch circuit 555 is provided that is connected to subprocessor 547 by data bus 552. Data for 40 places of 35 dots per place is latched in latch circuit 555, and an anode driver 556 acts on all the places to effect display of this data for 40 places.

Figure 3:
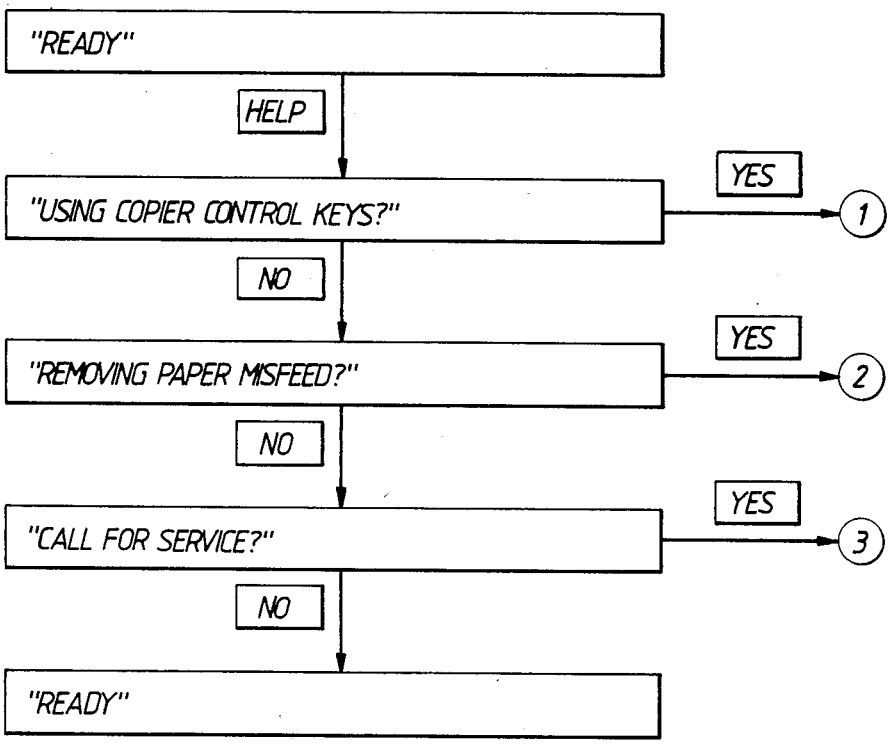
Figure 4:
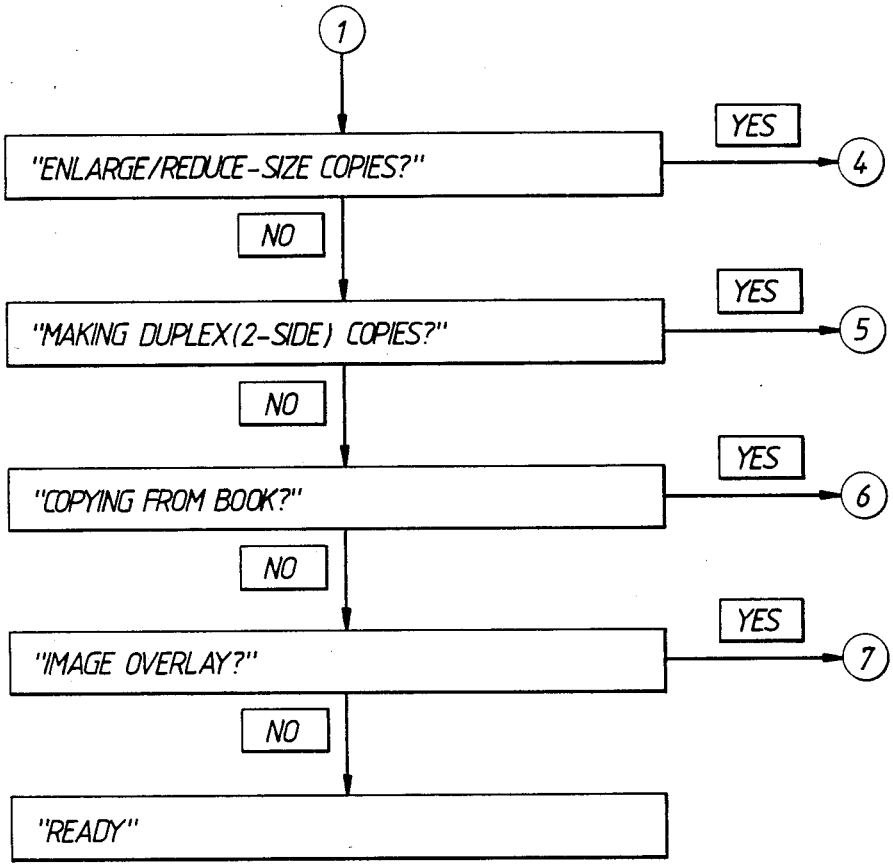
Figure 5:
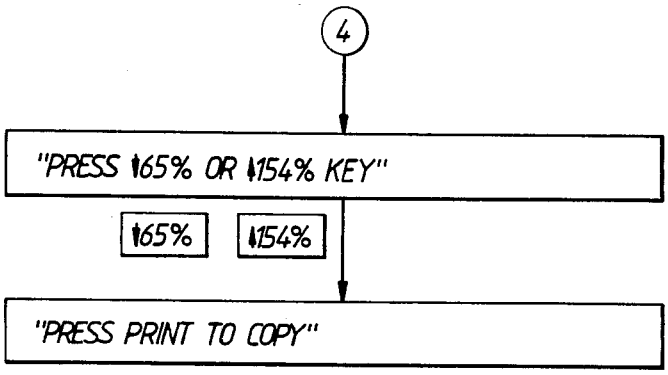

Next, the operation of the device will be described with reference to the flowcharts shown in FIGS. 3 through 6. FIG. 3 is the flowchart for the case where HELP key 508 has been depressed while the copying machine status is displayed in first display section 15. Depression of HELP key 508 when "READY" is displayed results in display of the question "USING COPIER CONTROL KEYS?". If, now, the user presses NO key 510, the question "REMOVING PAPER MISFEED?" is displayed. Subsequently, the content of the question changes each time NO key 510 is pressed, until finally there is a return to the textual display "READY". Pressing YES key 509 in response to any of the questions results in display of more detailed questions or of the operational procedure relating to the item concerned. (1)-(3) in FIG. 3 correspond to this situation. A description of case (1) will be given here by way of example. If, for example, NO key 510 is depressed in response to written display of the question "ENLARGE/REDUCE-SIZE COPIES?", a written display of the question "MAKING DUPLEX (2 SIDE) COPIES?" appears, and subsequently the content of the question changes each time NO key 510 is depressed, until finally there is a return to the textual display "READY". Pressing YES key 509 in response to any of the questions results in display of more detailed questions or of the operational procedure relating to the item concerned. (4)-(7) in FIG. 4 correspond to this situation. A description of ases (4) and (5) will be given here by way of example. First, to describe case (4), if, for example, the magnification is set by pressing reduction key 514 or enlargement key 513 in response to the display "PRESS 65% OR 154% KEY" as shown in FIG. 5, the text "PRESS PRINT TO COPY" is displayed, whereupon copying operation is started by pressing copy key 501.

Figure 6:
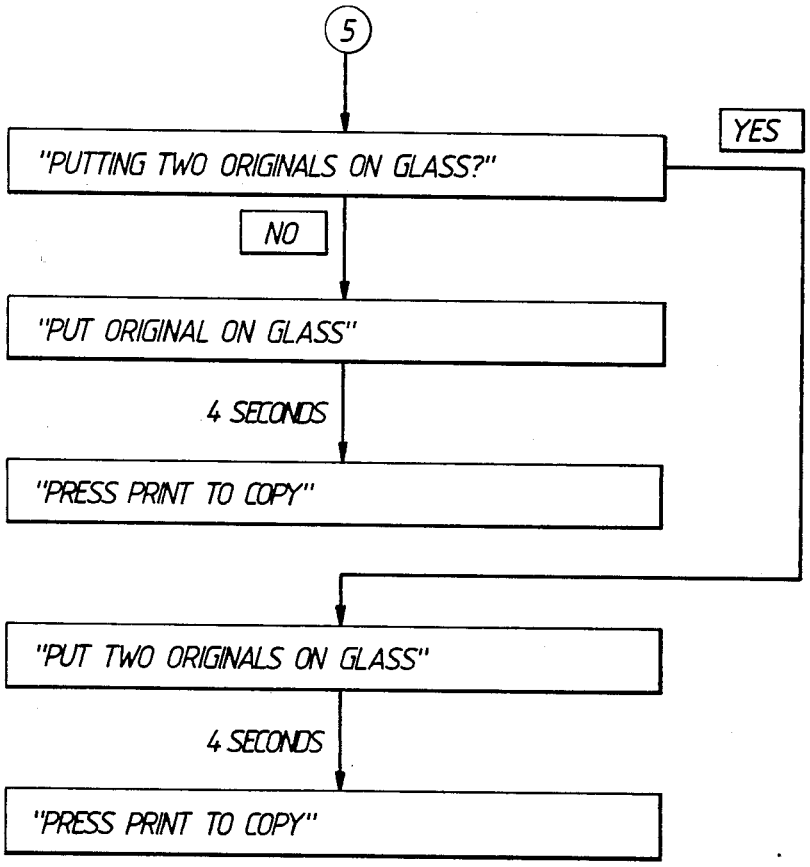

Next, to describe case (5), if, for example, NO key 510 is pressed in response to display of the question "PUTTING TWO ORIGINALS ON GLASS?" as shown in FIG. 6, the text "PUT ORIGINAL ON GLASS" is displayed, and when this happens mode display key 526 lights up and there is an automatic changeover to single original document, both-side copying mode. In this embodiment, about 4 seconds after this display, the text "PRESS PRINT TO COPY" is displayed. If YES key 510 is pressed in response to display of the question "PUTTING TWO ORIGINALS ON GLASS?", the text "PUT TWO ORIGINALS ON GLASS" is displayed, and when this happens mode display lamp 527 lights up and there is an automatic changeover to two original documents, both-side copying mode. This is similarly followed by an automatic display of the text "PRESS PRINT TO COPY" after about 4 seconds.

Although description has been given above in relation to the method of effecting enlarged or reduced copying and the method of effecting both-side copying, if the user is used to the machine, it is possible to dispense with use of HELP key 508 and to effect copying by proceeding directly to actuation of magnification change key 511 or mode setting key 524 when "READY" is displayed. YES key 509 or NO key 510 can be used to reply to displayed questions or suitable operations can be effected by proceeding in accordance with a displayed operating procedure in exactly the same way for removal of jammed paper, service call procedure, copying of books or overlaid copying (double copying).

Figure 7A:
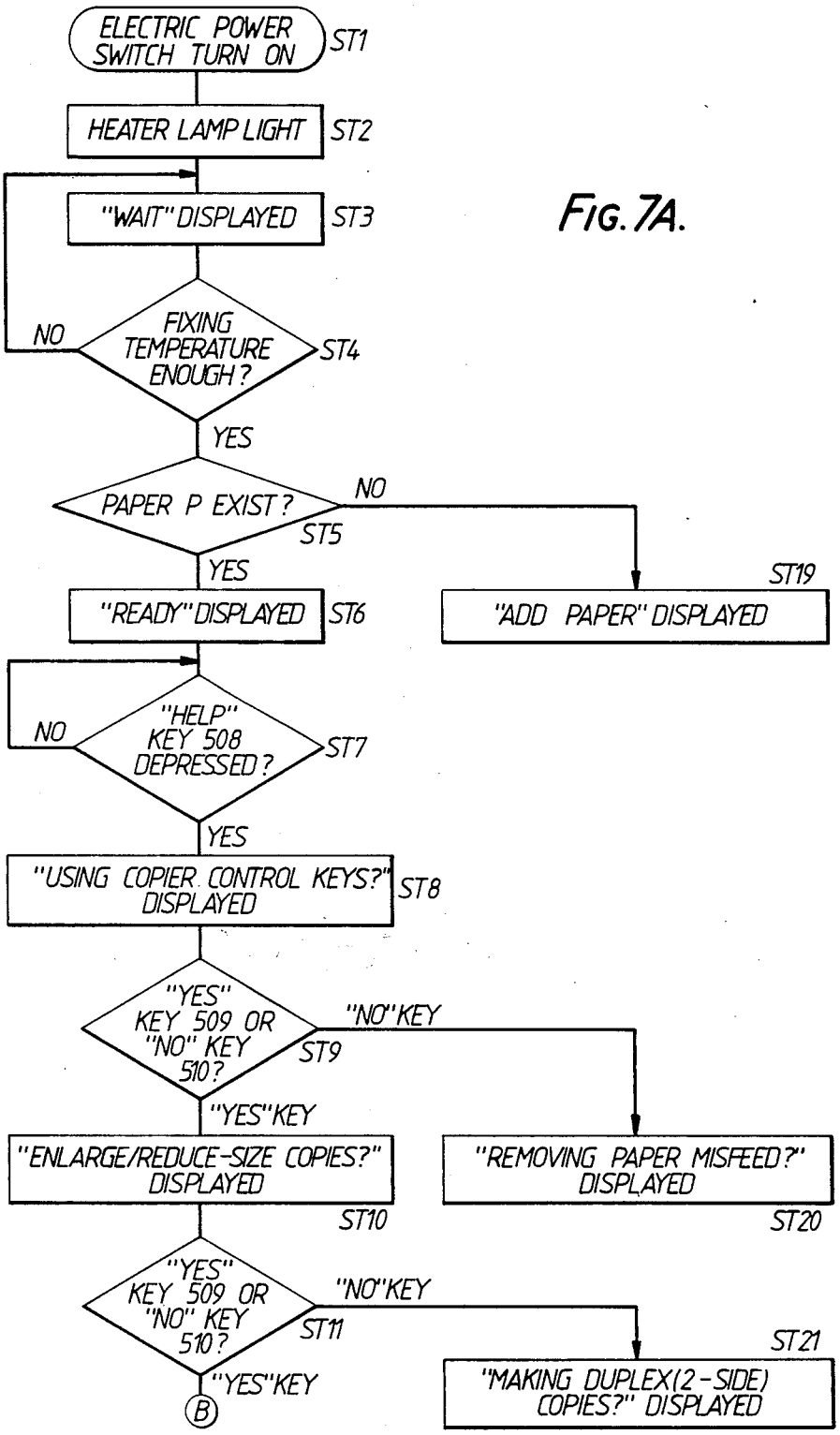
FIGS. 7A and 7B are flowcharts for more detail explaining the operations.
Figure 7B:
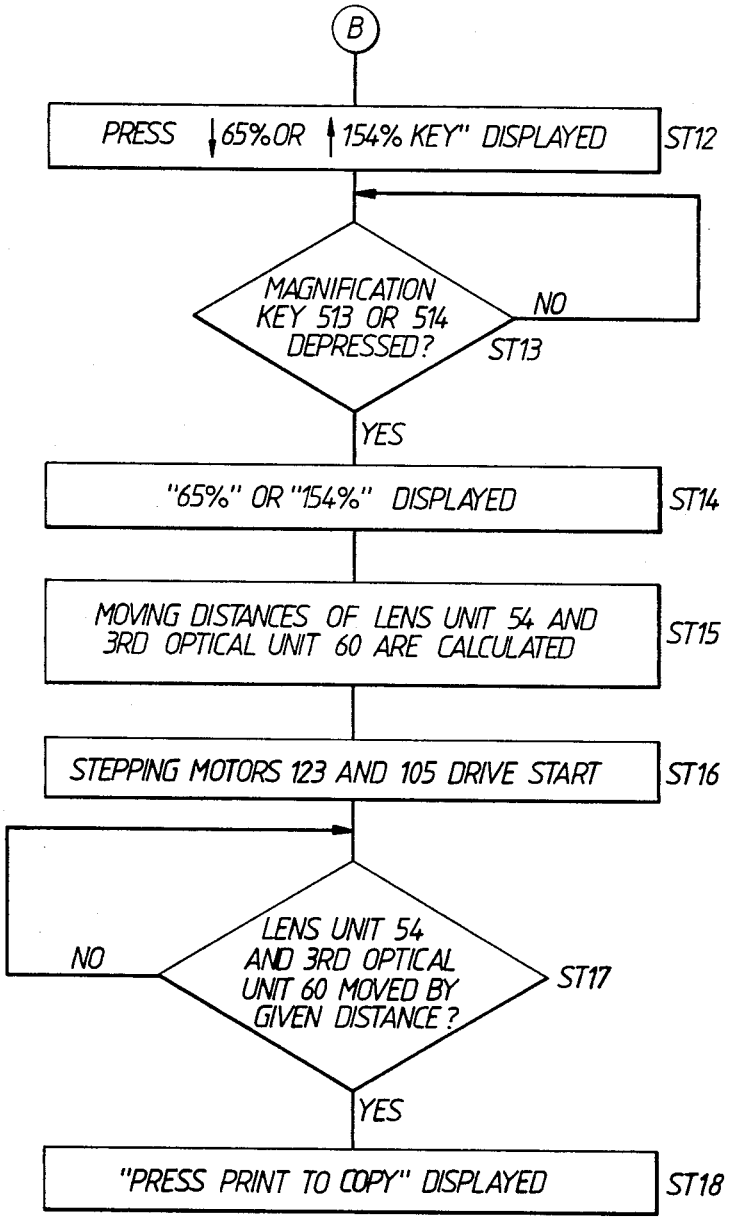

Next, the operation for displaying any messages in first display section 515 will be described in more detail in relation to input device 541 (shown in FIG. 2) for detecting conditions in the copying machine, e.g., of various sensors, switches or key switches on the control panel, etc., with reference to the flowcharts shown in FIGS. 7A and 7B. By turning on the electric power switch provided on copying machine main body 1 (ST1), the heater lamp incorporated into fixing unit 25 lights (ST2); at the same time, a message "WAIT" is displayed in first display section 515 (ST3). The temperature of the heater lamp lighted on step ST2 is detected by a heat sensor of input device 541 so as to be judged by main processor 545 whether or not the temperature is enough to fixation (ST4). If the temperature of the heater lamp is enough to fixation, sensors 300 and 301 of input device 541, detect whether copy paper P is in cassettes 7, 8 and 9 (ST5). If no copy paper P is in cassettes 7, 8 and 9, a message "ADD PAPER" is displayed in first display section 515 (ST19). If copy paper P is in cassettes 7, 8 and 9, a message "READY" is displayed in first display section 515 (ST6). Then, main processor 508 judges whether HELP key 508 provided on control panel 6, is depressed by a user (ST7). If the HELP key 508 is depressed, a question message "USING COPIER CONTROL KEYS?" is displayed in first display section 515 (ST8). Main processor 545 judges whether YES key 509 or NO key 510 is depressed by the user in response to the question "USING COPIER CONTROL KEYS?" (ST7). If the NO key 510 is depressed, a question message "REMOVING PAPER MISFEED?" is displayed in first display section 515 (ST20). If the YES key 509 is depressed, a question "ENLARGE/REDUCE-SIZE COPIES?" is displayed in first display section 515 (ST10). Main processor 545 judges whether YES key 509 or NO key 510 is depressed in response to the question of step ST10 (ST11). If the NO key 510 is depressed, a question message "MAKING DUPLEX (2-SIDE) COPIES?" is displayed in first display section 515 (ST21). If the YES key 509 is depressed, a message "PRESS ↓65% OR ↑154% KEY" is displayed in first display section 515 (ST12). Main processor 545 judges whether reduction key 513 (65%) or enlargement key 513 (154%) was depressed in response to the message of step ST12 (ST13). A numeral message "65%" or "154%", i.e., an enlargement/reduction rate, is displayed in the left side of first display section 515 in response to the depression of a key (ST14). Main processor 545 calculates the step number corresponding to the distance at which lens unit 54 and third optical unit 60 of optical exposure apparatus 14 should be moved according to the enlargement/reduction rate (ST15). Then, stepping motors 123 and 105 receive a pulse voltage corresponding to the step number and stepping motors 123 and 105 drive lens unit 54 and third optical unit 60 (ST16). Main processor 545 counts the step number corresponding to pulse voltage supplied to stepping motors 123 and 105 to determine whether the counted number is equal to the step number calculated by main processor 545. That is, main processor 545 judges wheter lesn uni 54 and third optical unit 60 are moved a given distance (ST17). After lens unit 54 and third optical unit 60 are moved a given distance, a message "PRESS PRINT TO COPY" is displayed in first dispaly section 515 (ST18). AT this time, if the user depress print key 501, copying operation is performed according to designated enlargement/reduction rate.

Many messages (for example) as follows are used for the present invention.

1. Related to the copying machine state:

"WAIT 30 SEC. WARMING UP"
"READY FOR BYPASS FEEDING"
"COPYING"
"READY TO RESUME JOB 1"
"SORTER NOT READY"
"COLOR IS RED"

2. Related to the operation guide:

-continued

| |
|---|
| "CLOSE FRONT COVER" |
| "PUT BOOK ON GLASS" |
| "PUT NEW BAG IN RECEPTACLE" |
| "INSERT ORIGINAL IN DOC. FEEDER" |
| "TURN OVER PAGE AND PRESS PRINT" |
| "PULL FRONT COVER OPEN" |
| "PRESS COPY SIZE, ORIGINAL SIZE" |
| "PRESS HELP FOR NEXT STEP" |
| "REMOVE USED TONER RECEPTACLE" |
| "CENTER BOOK ON YELLOW LINE" |
| 3. Related to the question: |
| "REMOVING USED TONER?" |
| "MAKING COLOR COPYING?" |
| "REPLACING COLOR TONER?" |
| "WANT ALL COPIES ONE SIZE?" |
| "WANT MESSAGE REPEATED?" |
| "WANT COPY CONTINUED?" |
| "WANT HELP WITH BOOK COPY?" |

Thus, textual displays of operational procedure, etc. on a control panel make it possible, even for a user who is not used to the machine, to effect required operations properly without becoming confused and without having to consult an instruction manual etc. each time. Furthermore, waste due to incorrect operation is minimized.

Although, in the above-described embodiment, the description was given with referenee to use in the display device of a copying machine, the invention is not limited to this but may be employed in any image formation apparatus in which required images are formed by operations by a user, as in an electronic printer or facsimile device, etc.

What is claimed is:

1. A display device for use in an image forming apparatus, comprising:

detection means for detecting a condition of an image forming apparatus;

display means for normally displaying a condition message representing the condition of said image forming apparatus on the basis of the detection by said detection means;

processing means for: (1) selectively causing a first message to be displayed on said display means, said first message providing a prompt for user related to an operation of said image forming apparatus, (2) selectively causing a second message to be displayed on said display means, said second message providing a procedure for performing said operation represented by said first message of said image forming apparatus, and (3) selectively causing a third message to be displayed on said displaying means, said third message providing a prompt for a user related to an operation, different from said operation identified by said first message, of said image forming apparatus.

2. A device according to claim 1, wherein said first message is displayed in the form of a question in response to manually entered command.

3. A device according to claim 2, wherein said second message is displayed in response to a manually entered command representing an affirmative response to said first message.

4. A device according to claim 2, wherein said third message is displayed in response to a manually entered command representing a negative response to said first message.

5. A device according to claim 1, wherein said second and third messages display operation methods, and when the operation is performed, at least one of guidance for a following operation and a condition message is automatically displayed in said display means.

6. A device according to claim 1, wherein said display means are provided on a operation panel of said image forming apparatus.

7. A device according to claim 1, wherein said image forming apparatus comprises a copying machine.

* * * * *